US012434292B2

(12) United States Patent
Park et al.

(10) Patent No.: US 12,434,292 B2
(45) Date of Patent: Oct. 7, 2025

(54) PRESS FORMING APPARATUS

(71) Applicants: HYUNDAI MOTOR COMPANY, Seoul (KR); KIA CORPORATION, Seoul (KR)

(72) Inventors: Sang Wook Park, Hwaseong-si (KR); Yong Shin Choi, Anyang-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 353 days.

(21) Appl. No.: 17/961,344

(22) Filed: Oct. 6, 2022

(65) Prior Publication Data

US 2023/0364668 A1 Nov. 16, 2023

(30) Foreign Application Priority Data

May 10, 2022 (KR) ..... 10-2022-0057397

(51) Int. Cl.
*B21J 13/02* (2006.01)

(52) U.S. Cl.
CPC ..... *B21J 13/025* (2013.01)

(58) Field of Classification Search
CPC ..... B21D 22/06; B21D 19/08; B21D 19/082; B21D 19/084; B21D 19/086; B21D 53/88; B21D 15/245; B21D 37/08; B21D 37/10; B21J 13/025
See application file for complete search history.

(56) References Cited

U.S. PATENT DOCUMENTS

| | | | | |
|---|---|---|---|---|
| 6,755,070 | B2 * | 6/2004 | Jung | B21D 37/08 72/313 |
| 8,250,896 | B2 | 8/2012 | Hirotani | |
| 2010/0186475 | A1 | 7/2010 | Hirotani | |

FOREIGN PATENT DOCUMENTS

| | | | | |
|---|---|---|---|---|
| CN | 115488237 | A * | 12/2022 | |
| EP | 1044739 | A2 * | 10/2000 | B21D 19/086 |
| JP | 3777942 | B2 * | 5/2006 | B21J 13/025 |
| JP | 2010167480 | A | 8/2010 | |
| JP | 2010207891 | A | 9/2010 | |
| JP | 2012176432 | A * | 9/2012 | |
| JP | 2013078777 | A | 5/2013 | |
| JP | 2018083203 | A | 5/2018 | |
| KR | 101455673 | B1 | 10/2014 | |

OTHER PUBLICATIONS

Translation of CN-115488237.*
Translation of EP-1044739.*
Translation of JP-2012176432.*
Translation of JP-3777942.*

* cited by examiner

*Primary Examiner* — Bobby Yeonjin Kim
(74) *Attorney, Agent, or Firm* — Lempia Summerfield Katz LLC

(57) ABSTRACT

Disclosed is a press forming apparatus including a lower die assembly having a lower die, an upper die assembly having an upper die configured to be movable in a first direction relative to the lower die, a cam slider configured to be movable in a second direction relative to the lower die, and a conversion mechanism configured to convert a movement of the upper die assembly in the first direction into a movement of the cam slider in the second direction.

17 Claims, 29 Drawing Sheets

<Prior Art>

PRESS FORMING APPARATUS

CROSS-REFERENCE TO RELATED APPLICATION

This application claims priority to and the benefit of Korean Patent Application No. 10-2022-0057397 filed in the Korean Intellectual Property Office on May 10, 2022, the entire contents of which are incorporated herein by reference.

TECHNICAL FIELD

The present disclosure relates to a press forming apparatus, and more particularly, to a press forming apparatus capable of improving precision in forming a workpiece.

BACKGROUND ART

In general, a press forming process is performed in multiple steps to manufacture a vehicle body panel, and various types of press forming apparatuses are required to perform the process.

The press forming apparatus includes an upper die configured to move at an upper side of the press forming apparatus, and a lower die disposed below the upper die and configured to support a workpiece.

Some of the vehicle body panels each have a rounded corner with a relatively small radius provided between two walls. Because the rounded corner has the relatively small radius, an angle between the two walls is an acute angle. The rounded corner with the relatively small radius may easily crack when the vehicle body panel is formed by the press forming apparatus. Therefore, it is difficult for the press forming apparatus to form the vehicle body panel having the rounded corner with the small radius disposed between the two walls. For this reason, two components are separately manufactured and then assembled by fastening, welding, or the like to define the rounded corner with the small radius. For example, referring to FIG. 1, a trunk lid 1 includes an upper wall 2 and a rear wall 3 connected to the upper wall 2 at a predetermined angle. Because a rounded corner between the upper wall 2 and the rear wall 3 has a relatively small radius, the upper wall 2 and the rear wall 3 are hardly formed as a unitary one-piece structure by the press forming apparatus. In the related art, the rear wall 3 and the upper wall 2 having a flange 2*a* are separately manufactured by press forming, and the rear wall 3 is fixed to the flange 2*a* of the upper wall 2 by fastening, welding, or the like. As described above, in the related art, because the trunk lid 1 has the rounded corner with the relatively small radius, it is difficult for the press forming apparatus to form the trunk lid 1 as a unitary one-piece structure. Therefore, the two components (the upper wall and the rear wall) are separately manufactured and then assembled through a separate assembly process. In other words, in the case of the vehicle body panel having the rounded corner with the relatively small radius disposed between the two walls, the unitary one-piece structure cannot be formed by the press forming apparatus, which causes a problem in that manufacturing costs are increased, and a manufacturing process is complicated.

The above information disclosed in this Background section is only for enhancement of understanding of the background of the present disclosure and therefore it may contain information that does not form the prior art that is already known to a person of ordinary skill in the art.

SUMMARY

The present disclosure provides a press forming apparatus capable of significantly improving precision in forming a workpiece.

In one embodiment of the present disclosure, a press forming apparatus includes: a lower die assembly having a lower die; an upper die assembly having an upper die configured to be movable in a first direction relative to the lower die; and a cam slider configured to be movable in a second direction relative to the lower die. The press forming apparatus further includes: a conversion mechanism configured to convert a movement of the upper die assembly in the first direction into a movement of the cam slider in the second direction. As described above, the cam slider may be moved in the second direction by the conversion mechanism when the upper die assembly moves in the first direction. Therefore, it is possible to effectively form the workpiece in multiple directions. In other words, the cam slider may cooperate with the upper die assembly by means of the conversion mechanism. Therefore, it is possible to stably form, in multiple directions, the workpiece supported on the lower die, thereby significantly improving the precision in forming the workpiece.

The conversion mechanism may be configured to provide an external force for moving the cam slider toward the lower die when the upper die assembly comes into contact with the lower die assembly. As described above, the conversion mechanism may provide the external force for moving the cam slider toward the lower die when the upper die assembly comes into contact with the lower die assembly (in particular, when the upper die assembly and the lower die assembly are closed). Therefore, it is possible to accurately move the cam slider.

The press forming apparatus may further include a cam guide configured to guide the movement of the cam slider, and the cam guide may be disposed on at least any one of the upper die assembly and the lower die assembly. Therefore, the movement of the cam slider may be accurately guided by the cam guide.

The conversion mechanism may be disposed on at least any one of the upper die assembly and the lower die assembly.

In another embodiment, the conversion mechanism may include: a power cylinder including a power-side rod configured to be advanced or retracted in the first direction; and a force-side rod hydraulically connected to the power cylinder and configured to be advanced or retracted in the second direction. In one embodiment, the force-side rod may include a force cylinder disposed to be directed toward the cam slider. As described above, the power-side rod may be advanced or retracted in the first direction, and the force-side rod may be advanced or retracted in the second direction, such that the cam slider may be moved toward the lower die or moved away from the lower die by the force-side rod.

The power-side rod may be configured to be retracted when the upper die assembly comes into contact with the lower die assembly, and a hydraulic fluid may flow from the power cylinder to the force cylinder as the power-side rod is retracted, such that the force-side rod is advanced. As described above, the force-side rod may be advanced by the retraction of the power-side rod, such that the force-side rod may push the cam slider toward the lower die, and thus the cam slider may accurately move.

The power cylinder may have a power-side hydraulic chamber configured to contain a hydraulic fluid, the force cylinder may have a force-side hydraulic chamber configured to contain the hydraulic fluid. The power-side hydraulic chamber may be configured to hydraulically communicate with the force-side hydraulic chamber through a hydraulic conduit. Therefore, the hydraulic fluid may flow from the power-side hydraulic chamber to the force-side hydraulic chamber through the hydraulic conduit when the power-side rod of the power cylinder is retracted, such that the force-side rod of the force cylinder may be advanced.

In one embodiment, the force cylinder may include: a force-side piston; the force-side rod connected to the force-side piston; and a force-side gas chamber separated from the force-side hydraulic chamber by the force-side piston. The force-side gas chamber may be filled with gas at a predetermined first pressure, and the first pressure of the gas contained in the force-side gas chamber may provide a biasing force that biases the force-side rod to a retracted position. As described above, the first pressure of the gas contained in the force-side gas chamber may provide the biasing force that retracts the force-side rod. Therefore, it is possible to easily return the force-side rod to the retracted position after the force-side rod is advanced.

In another embodiment, the conversion mechanism may further include a force-side control block connected to the force-side gas chamber through a force-side gas conduit. The force-side control block may include a pressure gauge configured to check the first pressure. As described above, the force-side control block may have the pressure gauge configured to check the first pressure. Therefore, it is possible to accurately set the first pressure in the force-side gas chamber, such that the force-side rod may be accurately returned to the retracted position by the first pressure after the force-side rod is advanced.

The press forming apparatus may further include a coupling block connected to the force-side hydraulic chamber through a hydraulic fluid supply conduit. The coupling block may be configured to remove air from the hydraulic fluid when the force-side hydraulic chamber is filled with the hydraulic fluid through the hydraulic fluid supply conduit. Because the coupling block removes air from the hydraulic fluid when the force-side hydraulic chamber and the power-side hydraulic chamber are filled with the hydraulic fluid as described above, the hydraulic fluid may more smoothly flow, and the movement of the force-side rod by the flow of the hydraulic fluid may be stably ensured.

The conversion mechanism may further include a tank hydraulically connected to the power cylinder through a hydraulic passageway. The tank may include a tank-side hydraulic chamber configured to communicate with the power-side hydraulic chamber through the hydraulic passageway. Because the tank has the tank-side hydraulic chamber configured to communicate with the power-side hydraulic chamber as described above, the amount of hydraulic fluid in the power-side hydraulic chamber of the power cylinder may be adjusted, and thus the power-side rod of the power cylinder may stably move.

The tank may include: a floating piston configured to be movable in the tank; and a tank-side gas chamber separated from the tank-side hydraulic chamber by the floating piston. The tank-side gas chamber may be filled with gas at a predetermined second pressure, and the second pressure of the gas contained in the tank-side gas chamber may apply provide a biasing force that biases the power-side rod to an advanced position. Because the second pressure of the gas contained in the tank-side gas chamber provides the biasing force that biases the power-side rod to the advanced position as described above, the power-side rod may be easily returned to the advanced position after an external force applied to the power-side rod is eliminated.

The conversion mechanism may further include a tank-side control block connected to the tank-side gas chamber through a gas conduit. The tank-side control block may include a pressure gauge configured to check the second pressure. As described above, the tank-side control block may have the pressure gauge configured to check the second pressure. Therefore, it is possible to accurately set the second pressure in the tank-side gas chamber, such that the power-side rod may be accurately returned to the advanced position by the second pressure when the external force applied to the power-side rod is eliminated.

The lower die assembly may further include a push member provided to face the power-side rod of the power cylinder, the push member may be aligned with a longitudinal axis of the power cylinder, and the power-side rod may be retracted by being pushed by the push member when the upper die assembly comes into contact with the lower die assembly. In particular, the push member may be disposed on the lower die assembly and positioned below the power-side rod, such that the power-side rod may be accurately retracted when the upper die assembly moves toward the lower die assembly.

The lower die may include: a first forming surface directed toward the upper die; a second forming surface directed toward the cam slider; and a rounded corner formed between the first forming surface and the second forming surface. The upper die may include a first pressing surface complementary to the first forming surface, and the cam slider may include a second pressing surface complementary to the second forming surface. Therefore, the first pressing surface of the upper die may press the workpiece toward the first forming surface of the lower die, and the second pressing surface of the cam slider may press the workpiece toward the second forming surface of the lower die, such that the rounded corner of the workpiece may be precisely formed to be complementary to the rounded corner of the lower die.

The upper die assembly may include an upper die housing on which the upper die is mounted. The cam guide may be mounted on the upper die housing, and the movement of the cam slider may be guided by the upper die and the cam guide. Because the movement of the cam slider may be accurately guided by the upper die and the cam guide in the upper die assembly as described above, the precision in forming the workpiece may be significantly improved.

The cam slider may include a pad aligned with the force-side rod of the force cylinder. Because the force-side rod of the force cylinder is aligned with the pad as described above, the force-side rod may be in contact with the pad. Therefore, it is possible to prevent an overload from being applied to the force-side rod of the force cylinder and prevent the cam slider from being abraded.

The cam slider may be configured to move between an advanced position to which the cam slider is advanced to press a workpiece supported on the lower die and a retracted position to which the cam slider is retracted away from the lower die. The press forming apparatus may further include a biasing member that biases the cam slider to the retracted position. Because the cam slider is retracted from the lower die by the biasing member as described above, the formed workpiece may be easily separated from the press forming apparatus.

According to the present disclosure, the cam slider may be moved in the second direction by the conversion mechanism when the upper die assembly moves in the first direction.

Therefore, it is possible to effectively form the workpiece in multiple directions. That is, the cam slider may cooperate with the upper die assembly by means of the conversion mechanism. Therefore, it is possible to stably form, in multiple directions, the workpiece supported on the lower die, thereby significantly improving the precision in forming the workpiece.

According to the present disclosure, the workpiece supported on the lower die may be precisely formed by the movement of the upper die and the movement of the cam slider. Therefore, it is possible to precisely form the rounded corner with the relatively small radius without causing cracks.

BRIEF DESCRIPTION OF THE DRAWINGS

In order that the disclosure may be well understood, there will now be described various forms thereof, given by way of example, reference being made to the accompanying drawings, in which.

Figure 1:
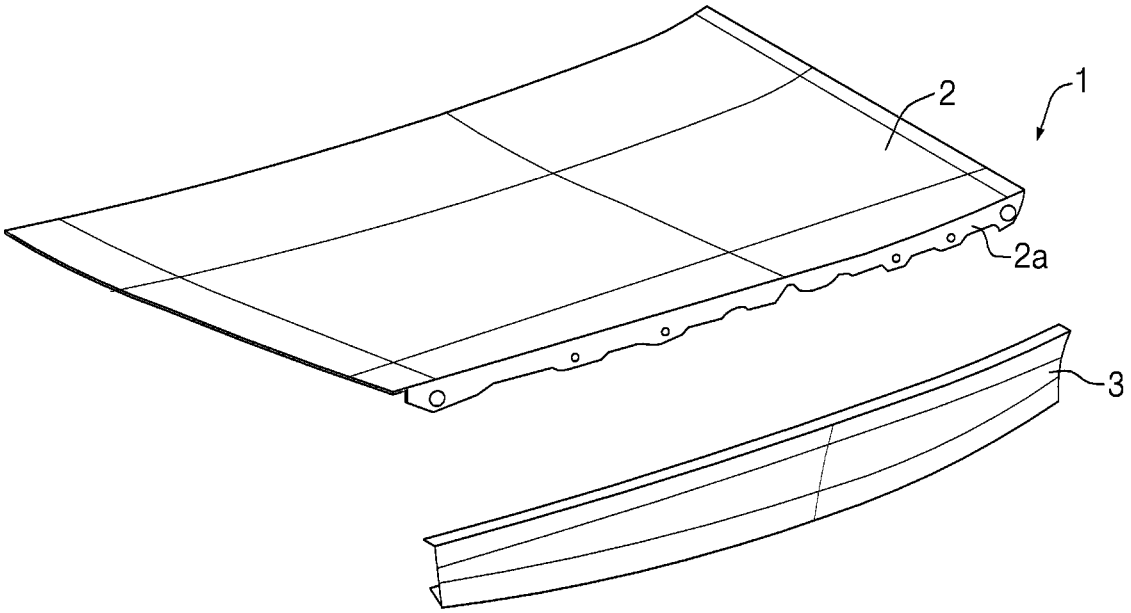
FIG. 1 is a view illustrating a state in which an upper wall and a rear wall of a trunk lid in the related art are separated.

The drawings described herein are for illustration purposes only and are not intended to limit the scope of the present disclosure in any way.

DETAILED DESCRIPTION

Hereinafter, some embodiments of the present disclosure are described in detail with reference to the illustrative drawings. In giving reference numerals to constituent elements of the respective drawings, it should be noted that the same constituent elements are designated by the same reference numerals, if possible, even though the constituent elements are illustrated in different drawings. Further, in the following description of the embodiments of the present disclosure, a detailed description of related publicly-known configurations or functions have been omitted when it is determined that the detailed description obscures the understanding of the embodiments of the present disclosure.

In addition, the terms first, second, A, B, (a), and (b) may be used to describe constituent elements of the embodiments of the present disclosure. These terms are used only for the purpose of discriminating one constituent element from another constituent element, and the nature, the sequences, or the orders of the constituent elements are not limited by the terms. Further, unless otherwise defined, all terms used herein, including technical or scientific terms, have the same meaning as commonly understood by those having ordinary skill in the art to which the present disclosure pertains. The terms such as those defined in commonly used dictionaries should be interpreted as having meanings consistent with meanings in the context of related technologies and should not be interpreted as ideal or excessively formal meanings unless explicitly defined in the present application.

When a component, device, element, or the like of the present disclosure is described as having a purpose or performing an operation, function, or the like, the component, device, or element should be considered herein as being "configured to" meet that purpose or to perform that operation or function.

A press forming apparatus according to one embodiment of the present disclosure may be configured to manufacture a desired component such as a vehicle body panel by pressing a workpiece such as sheet metal in multiple directions.

Figure 2:
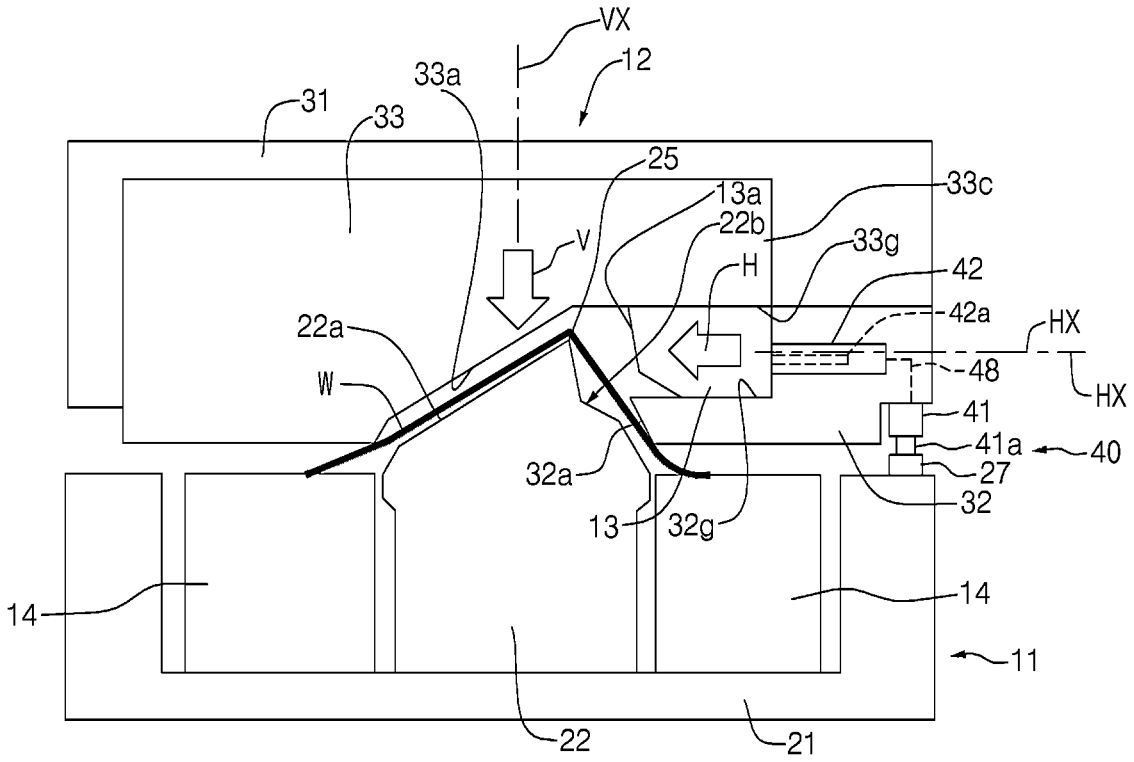
FIG. 2 is a view illustrating a state before a workpiece is formed by a press forming apparatus according to an embodiment of the present disclosure.

Referring to FIG. 2, the press forming apparatus according to one embodiment of the present disclosure may include a lower die assembly 11 configured to support a workpiece W such as sheet metal, and an upper die assembly 12 configured to be movable relative to the lower die assembly 11.

The lower die assembly 11 may include a lower die base 21, a lower die 22 mounted on the lower die base 21, and a blank holder 14 disposed around the lower die 22.

Figure 4:
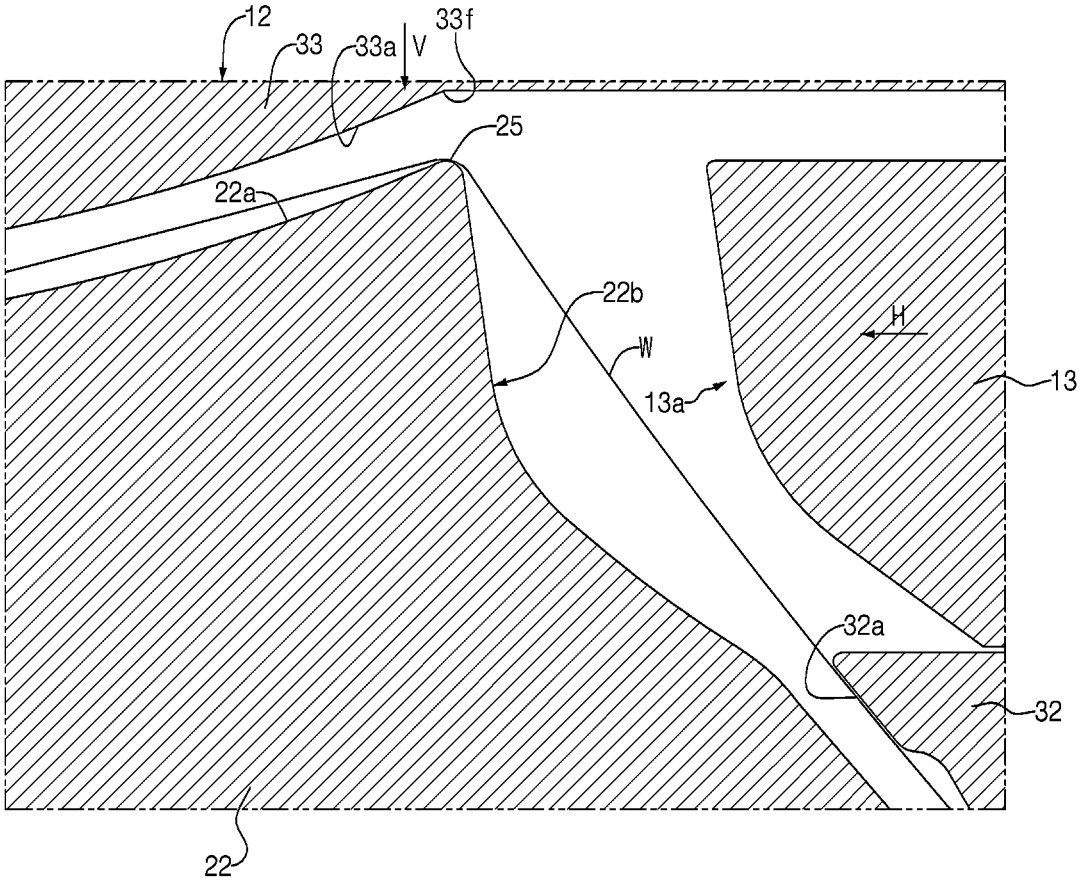
FIG. 4 is a view illustrating a state in which an upper die, a cam guide, and a cam slider are spaced apart from a lower die in the press forming apparatus according to one embodiment of the present disclosure.

The lower die 22 may include a first forming surface 22*a*, and a second forming surface 22*b* connected to the first forming surface 22*a* at a predetermined angle. The first and second forming surfaces 22*a* and 22*b* may be complementary to a designed shape of a component. The workpiece W may be supported by the first and second forming surfaces 22*a* and 22*b*. As illustrated in FIGS. 2 and 4, a rounded corner 25 may be positioned between the first and second forming surfaces 22*a* and 22*b*. The rounded corner 25 may be complementary to the designed rounded corner of the component.

The upper die assembly 12 may include an upper die housing 31, and an upper die 33 mounted on the upper die housing 31. The upper die 33 may have a first pressing surface 33*a* directed toward the first forming surface 22*a* of the lower die 22, and the first pressing surface 33*a* may be complementary to the first forming surface 22*a* of the lower die 22. Referring to FIGS. 4 to 6 and 20, an upper edge 33*f* of the first pressing surface 33*a* may be aligned with the rounded corner 25 of the lower die 22 in a vertical direction.

The upper die assembly 12 may be configured to move in a first direction V along a first axis VX. For example, the first axis VX may be a vertical axis, and the first direction V may be a vertical direction. When the upper die assembly 12 moves downward toward the lower die assembly 11, the upper die 33 moves downward toward the lower die 22, such that the first pressing surface 33*a* of the upper die 33 may press a portion of the workpiece W supported on the first forming surface 22*a* of the lower die 22.

Figure 3:
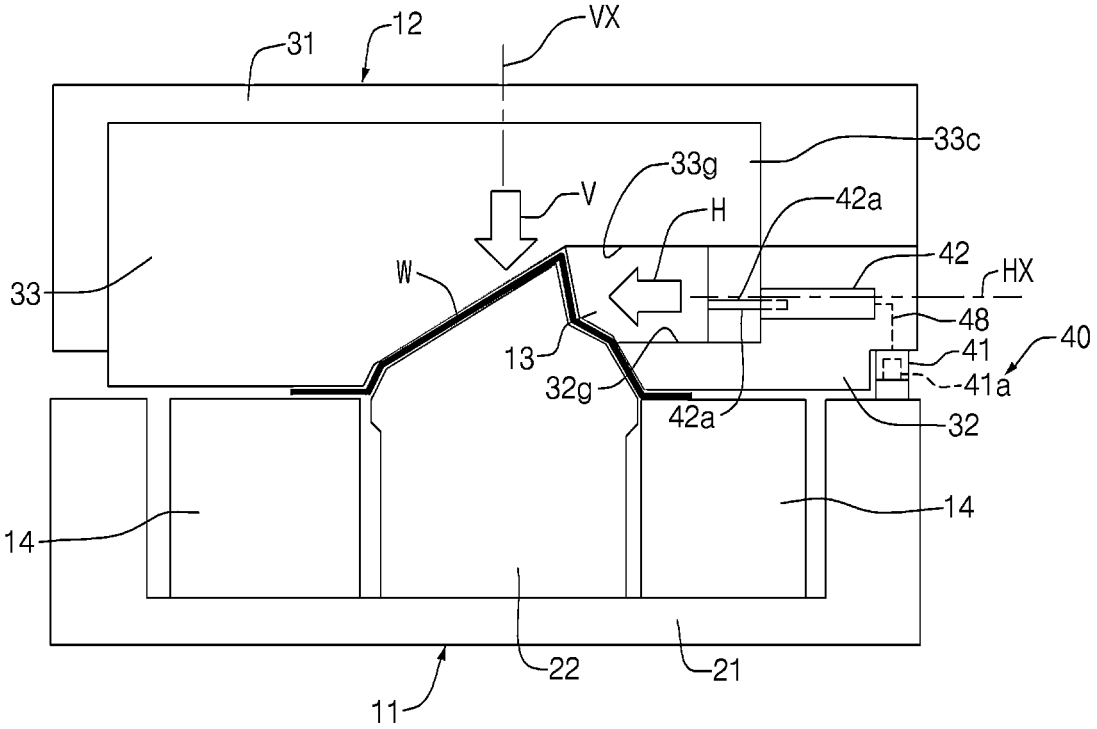
FIG. 3 is a view illustrating a process in which the workpiece is formed by the press forming apparatus according to the embodiment of the present disclosure.

Referring to FIGS. 2 and 3, the press forming apparatus may further include a cam slider 13 configured to be movable relative to the lower die 22 of the lower die assembly 11.

In particular, the cam slider 13 may be configured to move between an advanced position (see FIG. 3) to which the cam slider 13 is advanced to press the workpiece supported on the lower die 22 and a retracted position (see FIG. 2) to which the cam slider 13 is retracted away from the lower die 22.

The cam slider 13 may be configured to move in a second direction H along a second axis HX. For example, the second axis HX may be a horizontal axis, and the second direction H may be a horizontal direction. Therefore, the second axis HX may be orthogonal to the first axis VX. The cam slider 13 may have a second pressing surface 13*a* directed toward the second forming surface 22*b* of the lower die 22. The cam slider 13 may be disposed below the upper die assembly 12 and configured to be movable in the second direction H. Therefore, the press forming apparatus may be compact in layout and size, and the movement of the cam slider 13 may be stably ensured.

In another embodiment, the press forming apparatus may further include a cam guide 32 configured to guide the movement of the cam slider 13. The cam guide 32 may be mounted on at least one of the lower die assembly 11 or the upper die assembly 12.

According to the embodiment illustrated in FIGS. 2 and 3, the cam guide 32 may be mounted on a lower edge at one side of the upper die housing 31. The cam guide 32 may be directed toward one side edge of the lower die assembly 11. The cam guide 32 may have an auxiliary pressing surface 32*a* directed toward a lower portion of the second forming surface 22*b* of the lower die 22. The auxiliary pressing surface 32*a* may be complementary to the lower portion of the second forming surface 22*b*. When the upper die assembly 12 moves toward the lower die 22, the cam guide 32 may move in the second direction H toward the lower die 22, such that the auxiliary pressing surface 32*a* of the cam guide 32 may press a portion of the workpiece W supported on the second forming surface 22*b* of the lower die 22.

In one embodiment, the movement of the cam slider 13 may be guided between the upper die 33 and the cam guide 32. The upper die 33 may have a guide surface 33*g* configured to guide at least a portion of an upper surface of the cam slider 13. The cam guide 32 may have a guide surface 32*g* configured to guide at least a portion of a lower surface of the cam slider 13. Because the movement of the cam slider 13 is accurately guided by the upper die 33 and the cam guide 32 in the upper die assembly 12 as described above, the precision in forming the workpiece W is significantly improved.

Referring to FIG. 2, the press forming apparatus may further include a conversion mechanism 40 configured to convert the movement of the upper die assembly 12 in the first direction into the movement of the cam slider 13 in the second direction.

Referring to FIG. 3, the conversion mechanism 40 is configured to provide an external force that moves the cam slider 13 toward the lower die 22 when the upper die assembly 12 is completely in contact with the lower die assembly 11 (i.e., the upper die assembly 12 and the lower die assembly 11 are closed). As described above, when the upper die assembly 12 and the lower die assembly 11 are closed as the upper die assembly 12 moves toward the lower die assembly 11, the conversion mechanism 40 may provide the external force that moves the cam slider 13 toward the lower die 22. Therefore, the cam slider 13 may move to the advanced position, and thus the second pressing surface 13*a* of the cam slider 13 may accurately move in the second direction H toward the second forming surface 22*b* of the lower die 22.

The conversion mechanism 40 may be disposed on at least one of the upper die assembly 12 or the lower die assembly 11. The conversion mechanism 40 may include power cylinders 41 and force cylinders 42 hydraulically connected to the power cylinders 41 through hydraulic conduits 48.

Referring to FIGS. 2 and 3, the power cylinder 41 may be mounted on the upper die assembly 12. The power cylinder 41 may include a power-side rod 41*a*. The power-side rod 41*a* may be configured to be advanced or retracted along the first axis VX. The power-side rod 41*a* may be disposed to be directed toward the lower die assembly 11. The lower die assembly 11 may include push members 27 provided at edges thereof. The push member 27 may be aligned with a longitudinal axis of the power cylinder 41. The push member 27 may be positioned below the power-side rod 41*a*. Therefore, when the upper die assembly 12 moves toward the lower die assembly 11, the power-side rod 41*a* may be retracted by being pushed by the push member 27.

Referring to FIGS. 2 and 3, the force cylinder 42 may include a force-side rod 42*a*. The force-side rod 42*a* may be configured to be advanced or retracted along the second axis HX. The force-side rod 42*a* may be disposed to be directed toward the cam slider 13.

Referring to FIG. 2, when the upper die assembly 12 moves away from the lower die assembly 11, the power-side rod 41*a* may be advanced from a cylinder barrel of the power cylinder 41, the force-side rod 42*a* may be retracted into a cylinder barrel of the force cylinder 42, such that the cam slider 13 may be spaced apart from the lower die 22.

Referring to FIG. 3, the upper die assembly 12 may come into complete contact with the lower die assembly 11 as the upper die assembly 12 moves downward toward the lower die assembly 11. Therefore, as the power-side rod 41*a* is pushed by the lower die assembly 11, the power-side rod 41*a* may be retracted into the cylinder barrel of the power cylinder 41. As the power-side rod 41*a* is retracted, a hydraulic fluid contained in the cylinder barrel of the power cylinder 41 may be transmitted to the cylinder barrel of the force cylinder 42 through the hydraulic conduit 48, such that the force-side rod 42*a* may be advanced by the hydraulic fluid transmitted to the force cylinder 42, and the force-side rod 42*a* may push the cam slider 13. In other words, the power cylinder 41 may generate hydraulic power that advances the force-side rod 42*a* of the force cylinder 42. The force cylinder 42 may generate a force from the hydraulic power generated by the power cylinder 41, and the force may push the cam slider 13 toward the lower die 22.

FIG. 2 is a view illustrating a state before the workpiece W is formed. Referring to FIG. 2, the workpiece W is supported on the first and second forming surfaces 22*a* and 22*b* of the lower die 22, and the upper die assembly 12 and the cam slider 13 are spaced apart from the lower die assembly 11.

FIG. 3 is a view illustrating a process of forming the workpiece W. Referring to FIG. 3, the upper die assembly 12 and the lower die assembly 11 may be closed as the upper die assembly 12 moves toward the lower die assembly 11. Therefore, the upper die 33, the lower die 22, and the cam slider 13 may press the workpiece W, such that the component may be precisely formed in a designed shape. A bottom surface of the upper die 33 and a bottom surface of the cam guide 32 may press the edges of the workpiece W toward the blank holder 14.

Figure 5:
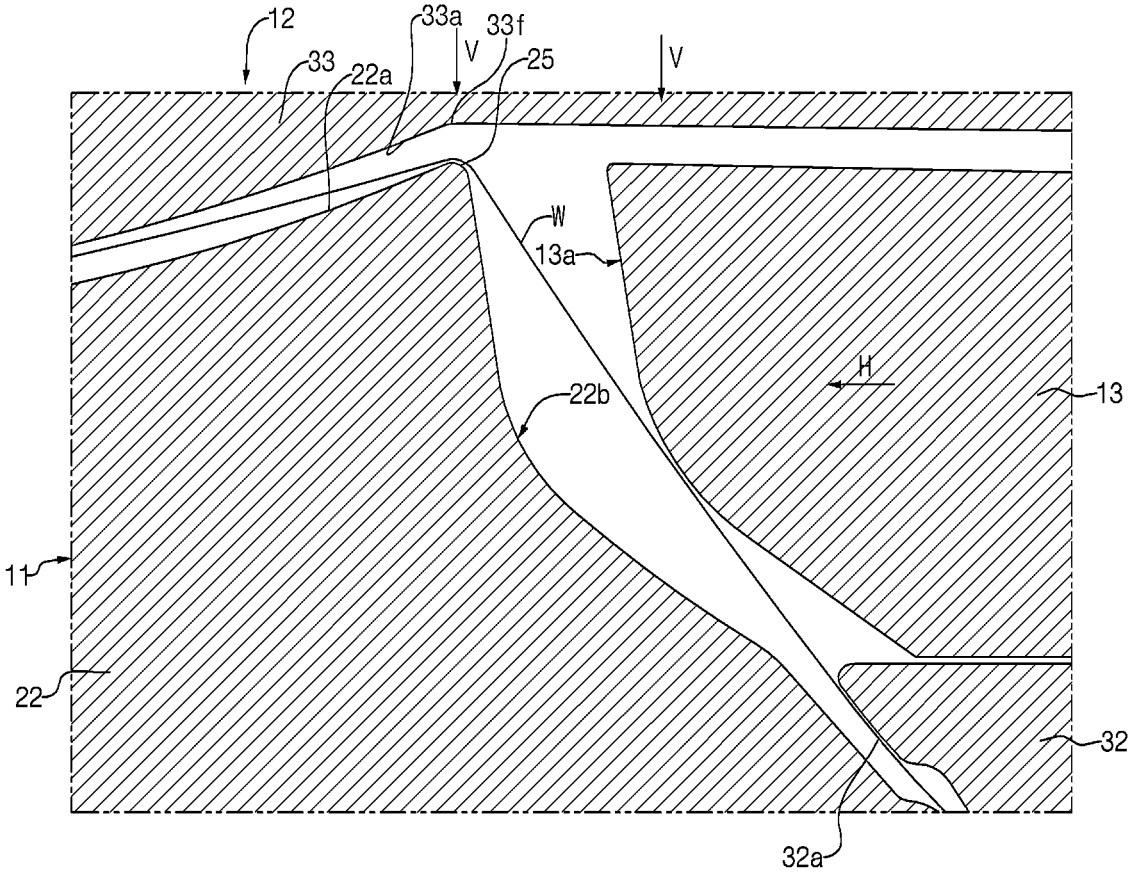
FIG. 5 is a view illustrating a process in which the upper die, the cam guide, and the cam slider approach the lower die in the press forming apparatus according to one embodiment of the present disclosure.
Figure 6:
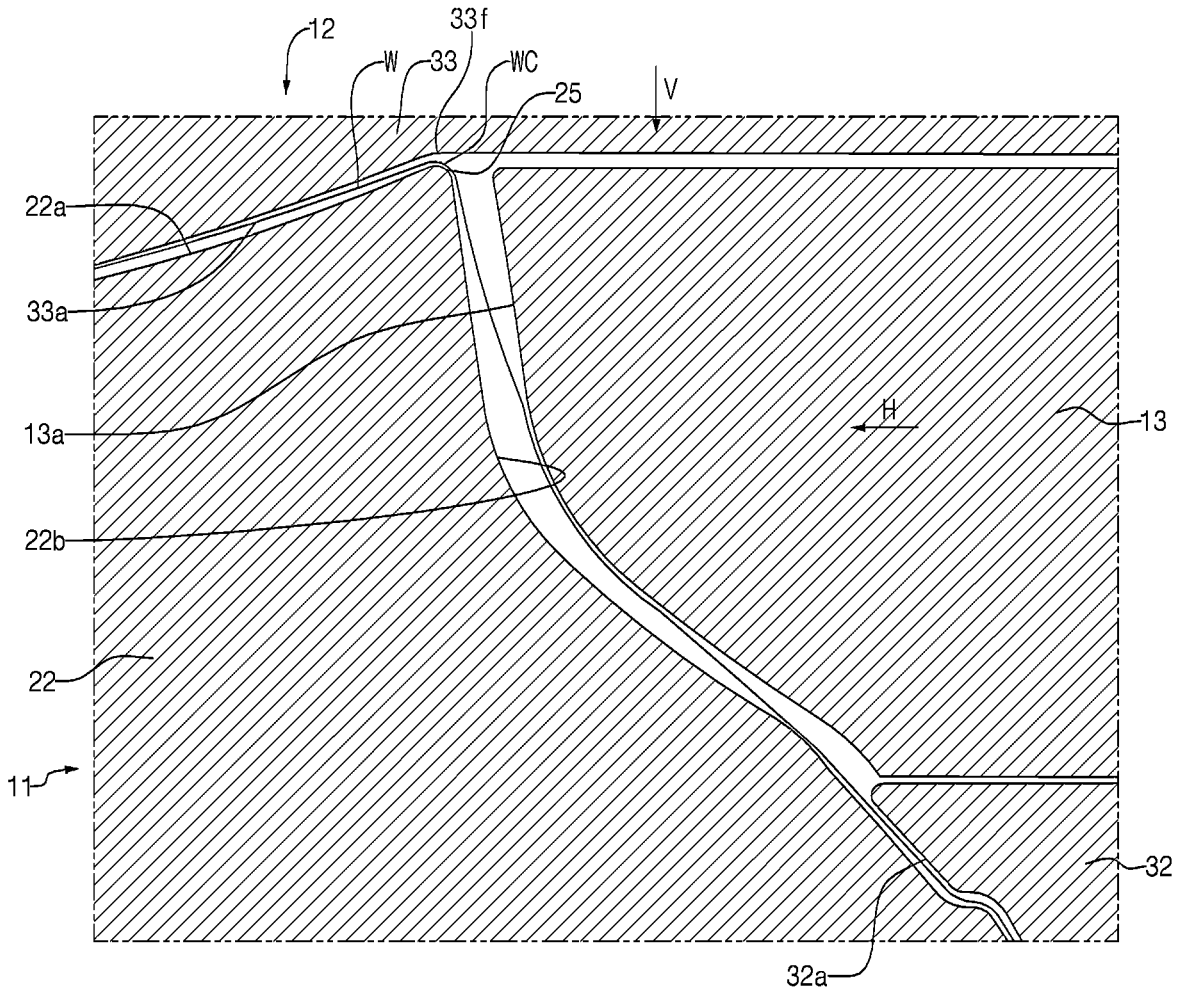
FIG. 6 is a view illustrating a process in which the upper die, the cam guide, and the cam slider further approach the lower die in the press forming apparatus according to one embodiment of the present disclosure.
Figure 7:
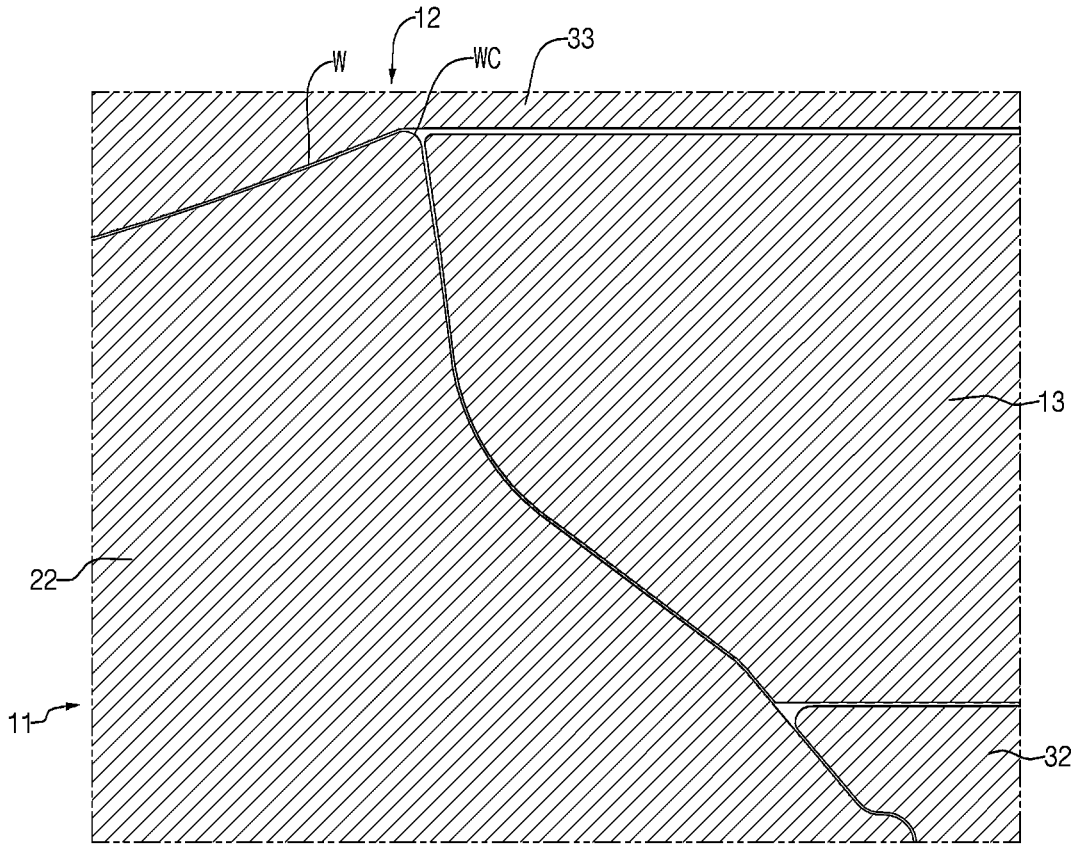
FIG. 7 is a view illustrating a process in which the workpiece is formed as the upper die, the cam guide, and the cam slider press the workpiece supported on the lower die in the press forming apparatus according to one embodiment of the present disclosure.
Figure 23:
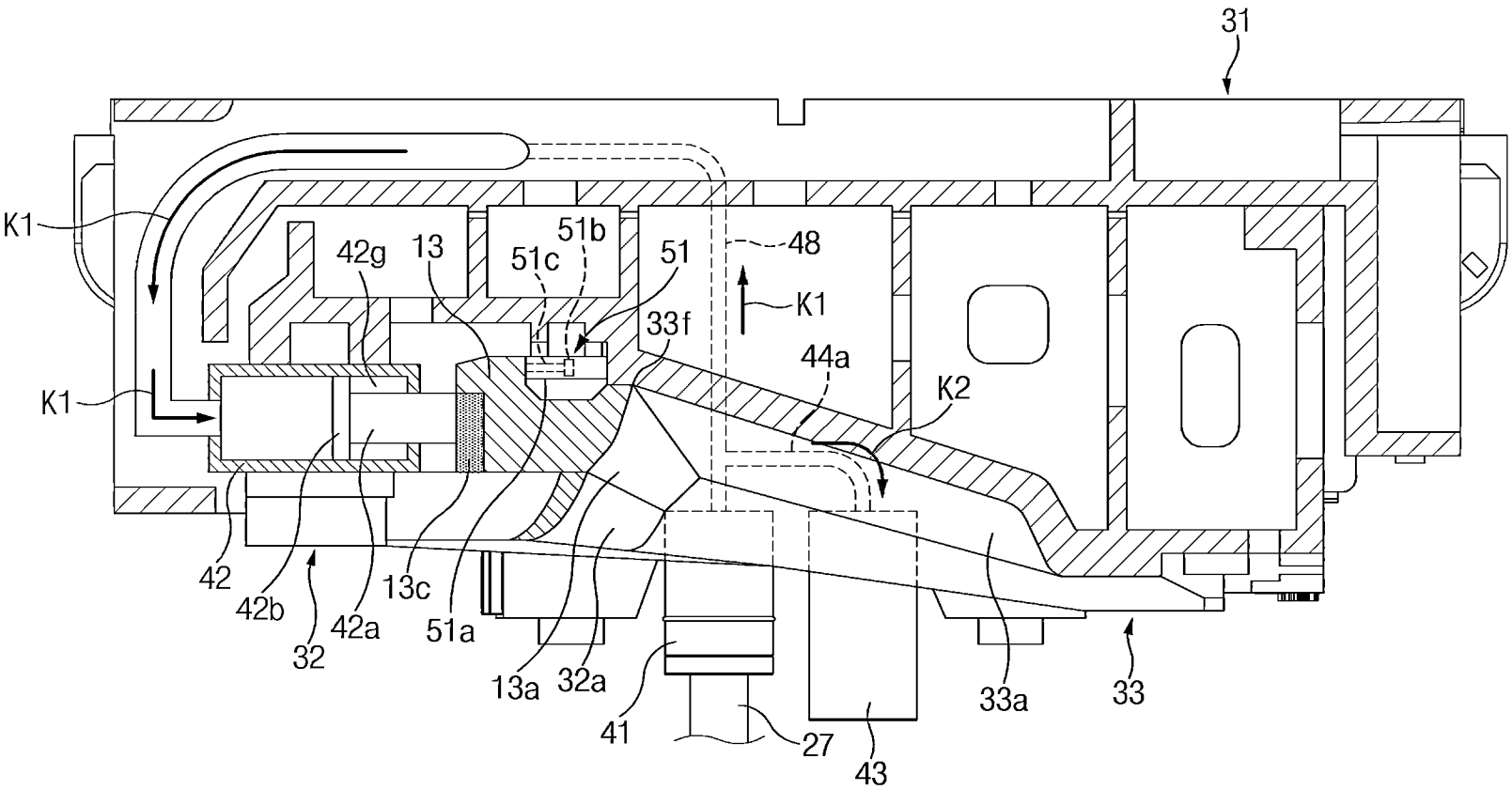
FIG. 23 is a view illustrating a process in which the power-side rod of the power cylinder is completely retracted by being pushed by the push member when the upper die assembly moves downward in the press forming apparatus according to one embodiment of the present disclosure.

FIGS. 4 to 7 are views illustrating processes of forming the workpiece W. Referring to FIG. 4, the upper die 33, the cam guide 32, and the cam slider 13 are spaced apart from the lower die 22. In this state, when the cam slider 13 is moved in the second direction H toward the lower die 22 by the conversion mechanism 40 (see FIGS. 2 and 3) as the upper die assembly 12 moves in the first direction V toward the lower die assembly 11, the first pressing surface 33*a* of the upper die 33 may become closer to the first forming surface 22*a* of the lower die 22 in a stepwise manner, the second pressing surface 13*a* of the cam slider 13 may become closer to an upper region of the second forming surface 22*b* of the lower die 22 in a stepwise manner, and the auxiliary pressing surface 32*a* of the cam guide 32 may become closer to a lower region of the second forming surface 22*b* of the lower die 22 in a stepwise manner, as illustrated in FIGS. 5 and 6. In this case, the upper edge 33*f* of the first pressing surface 33*a* and an upper edge of the second pressing surface 13*a* may become closer to the rounded corner 25. Finally, as the upper die assembly 12 completely moves toward the lower die assembly 11, the upper die assembly 12 and the lower die assembly 11 may be closed. Further, as illustrated in FIGS. 7 and 23, an upper end edge of the cam slider 13 may come into contact with the upper edge 33*f* of the first pressing surface 33*a* of the upper die 33. As illustrated in FIG. 7, the upper die 33, the cam slider 13, and the cam guide 32 may press the workpiece W supported on the lower die 22, such that the workpiece W may be formed in a designed shape of the component. In particular, a rounded corner WC of the workpiece W with a relatively small radius may be precisely formed to be complementary to the rounded corner 25 of the lower die 22 by the movement of the upper die 33 and the movement of the cam slider 13. As described above, the workpiece W may be accurately formed in a designed shape of the component by the movement of the upper die assembly 12 and the movement of the cam slider 13. In particular, the cam slider 13 and the upper die 33 of the upper die assembly 12 may accurately move relative to the lower die 22 as the upper die assembly 12 moves along the first axis VX and the cam slider 13 moves along the second axis HX. Therefore, the workpiece pressed by the upper die 33, the cam slider 13, and the lower die 22 may obtain forming analysis results excellent in thinning, formability, major strains, skid lines, and the like.

FIGS. 8 to 14 are views illustrating the lower die assembly 11 and the upper die assembly 12 according to embodiments of the present disclosure.

Figure 8:
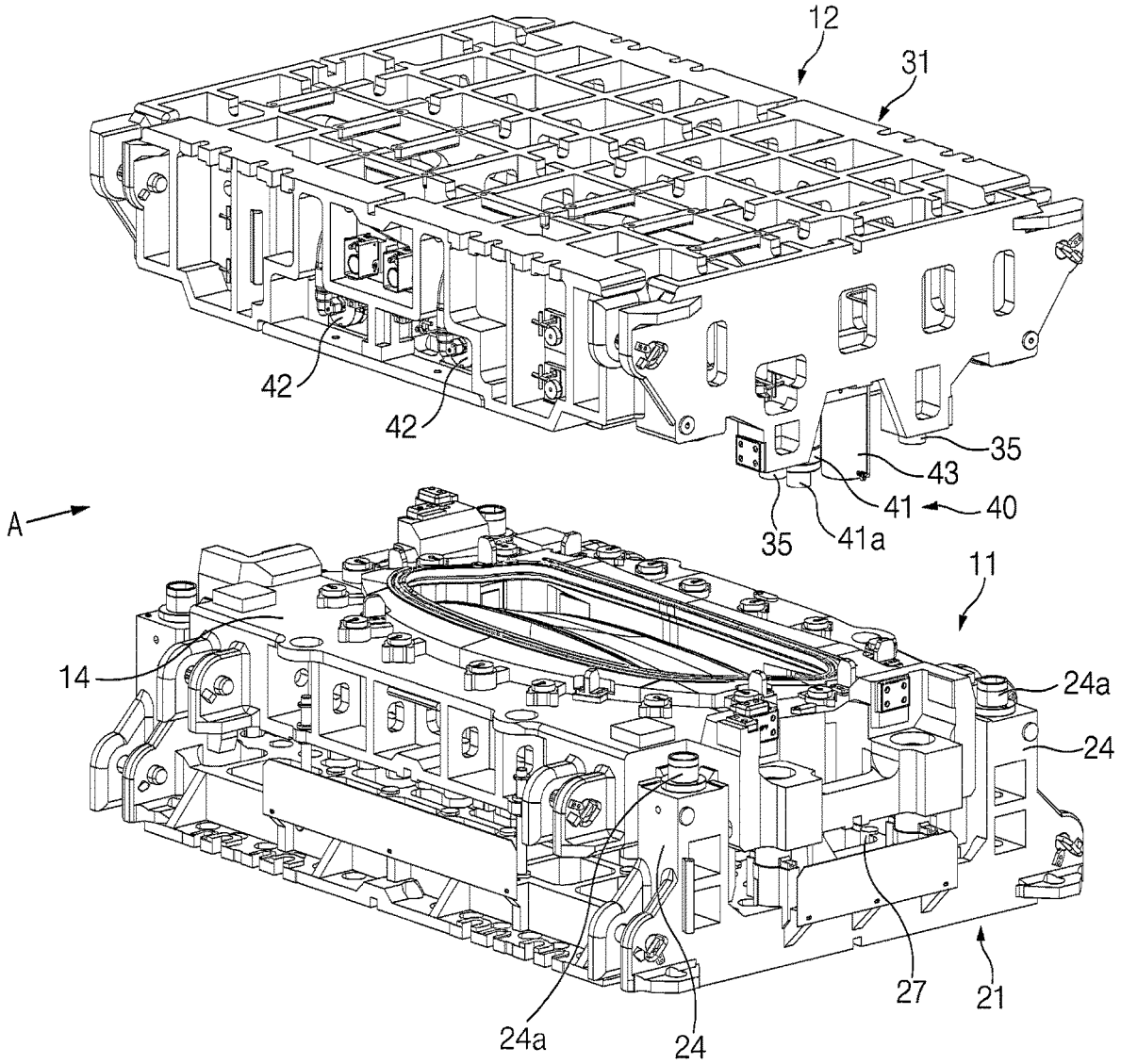
FIG. 8 is an exploded perspective view illustrating a state in which a lower die assembly and an upper die assembly of the press forming apparatus according to one embodiment of the present disclosure are separated.
Figure 9:
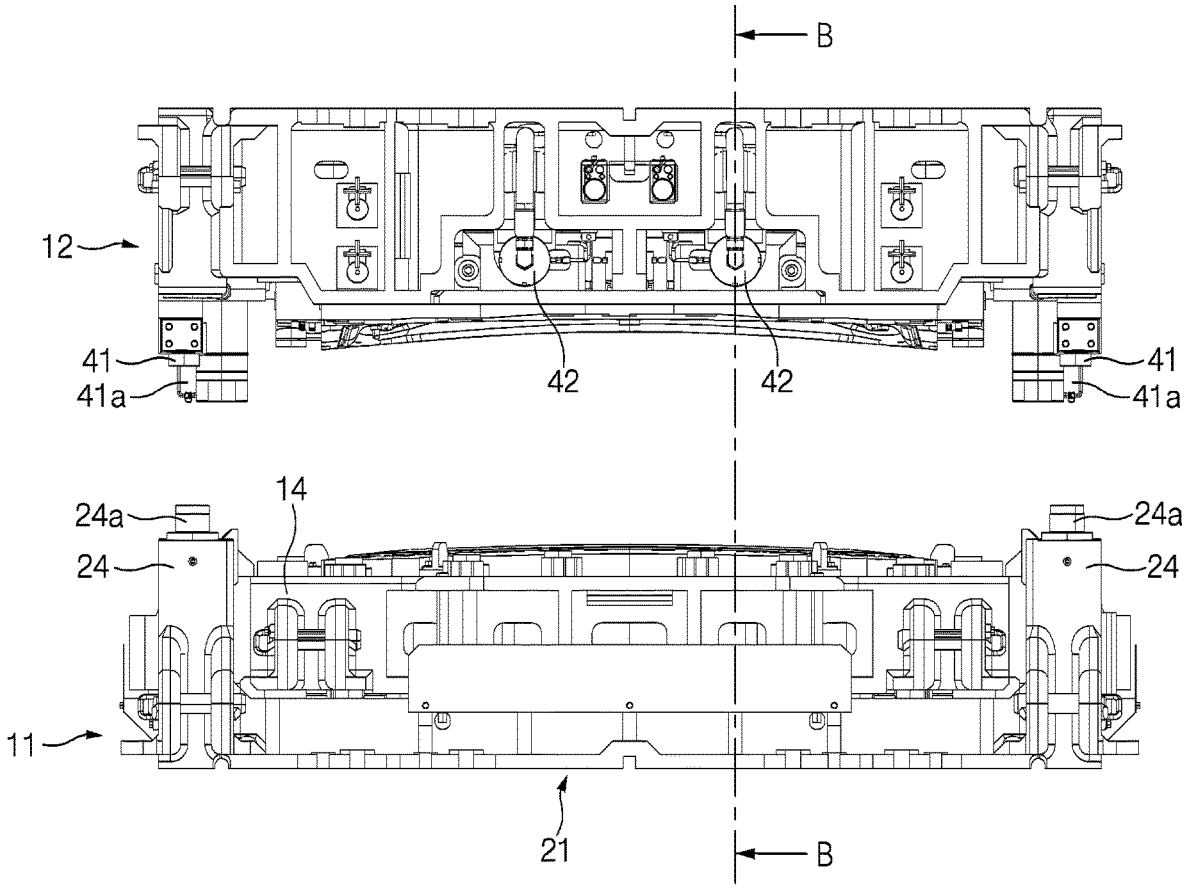
FIG. 9 is a view illustrating the press forming apparatus when viewed in a direction indicated by arrow A in FIG. 8.
Figure 10:
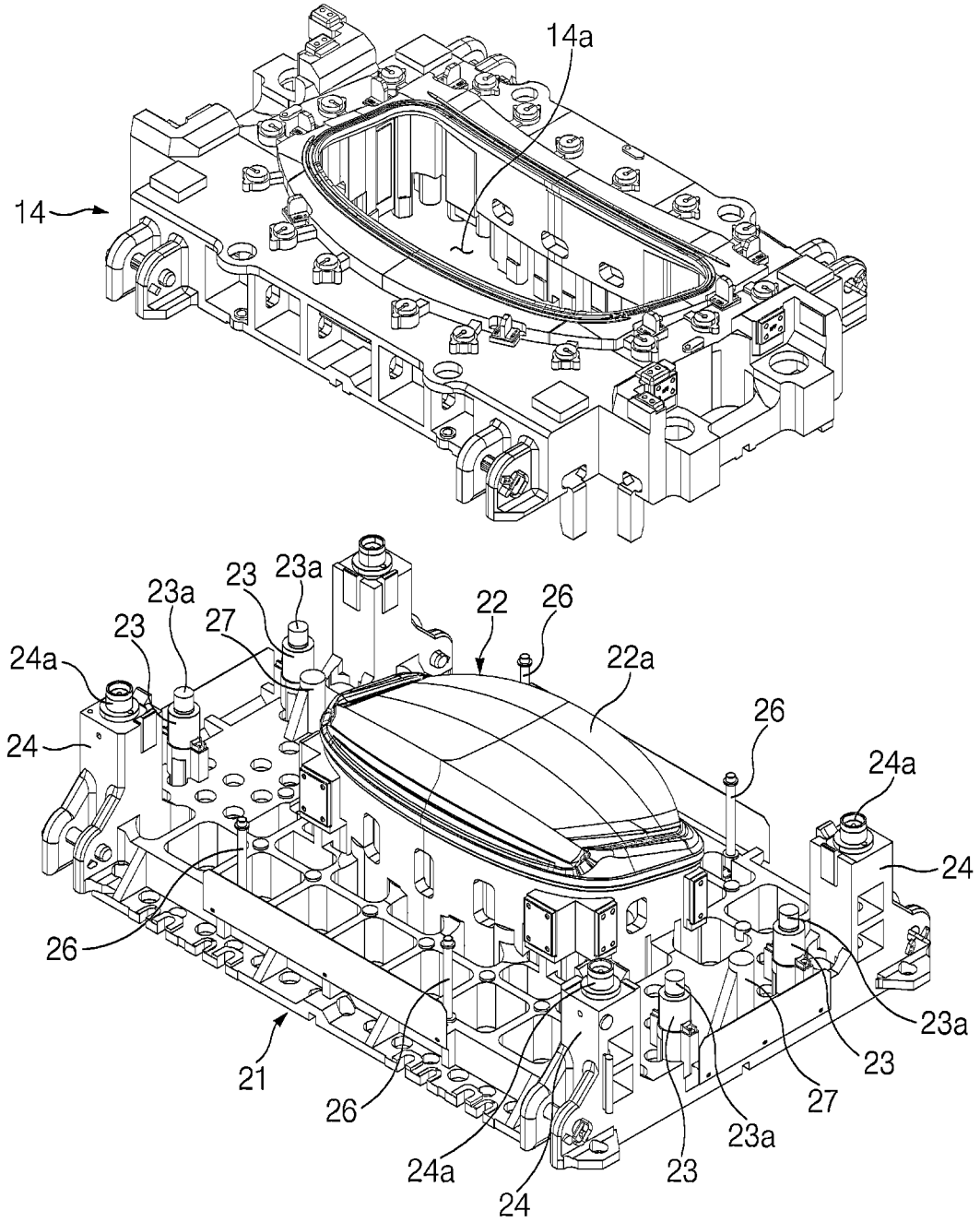
FIG. 10 is an exploded perspective view illustrate a state in which a lower die base and a blank holder of the lower die assembly of the press forming apparatus according to one embodiment of the present disclosure are separated.

Referring to FIGS. 8 and 10, the lower die base 21 may include a plurality of posts 24 arranged at edges thereof, and a plurality of guides 24*a* respectively provided on the plurality of posts 24. The guides 24*a* may each extend from the corresponding post 24 toward the upper die assembly 12.

Referring to FIG. 10, the lower die base 21 may include a plurality of gas springs 23 disposed to be directed toward the upper die assembly 12. The plurality of gas springs 23 may be disposed at the edges of the lower die base 21. The plurality of gas springs 23 may be configured to lessen impact that occurs between the upper die assembly 12 and the lower die assembly 11 when the upper die assembly 12 comes into contact with the lower die assembly 11. The gas springs 23 each include a rod 23*a* that may be advanced or retracted, and a cylinder of each of the gas springs 23 is filled with gas. The plurality of gas springs 23 may be positioned to be lower than the plurality of posts 24.

Referring to FIG. 10, the push member 27 may extend from the edge of the lower die base 21 toward the upper die assembly 12.

Figure 18:
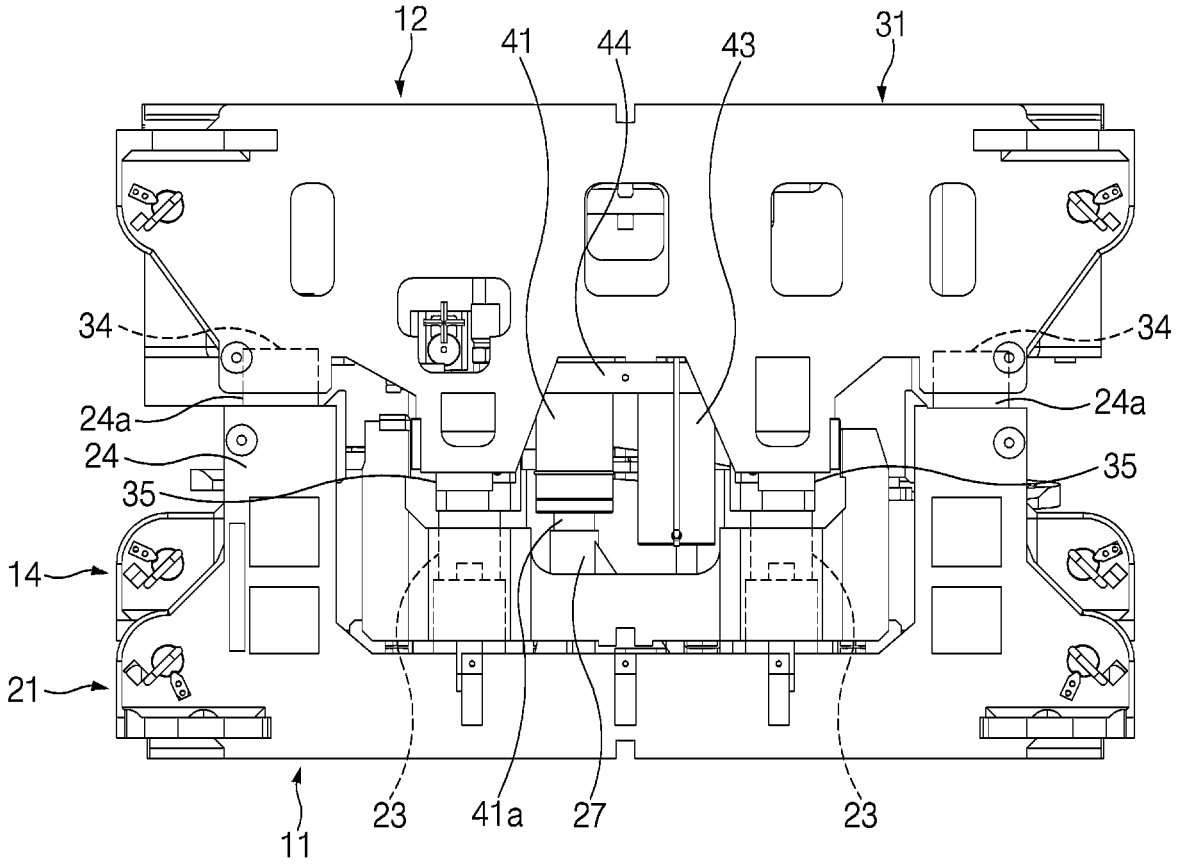
FIG. 18 is a view illustrating a state in which the upper die assembly and the lower die assembly are closed in the press forming apparatus according to one embodiment of the present disclosure.
Figure 19:
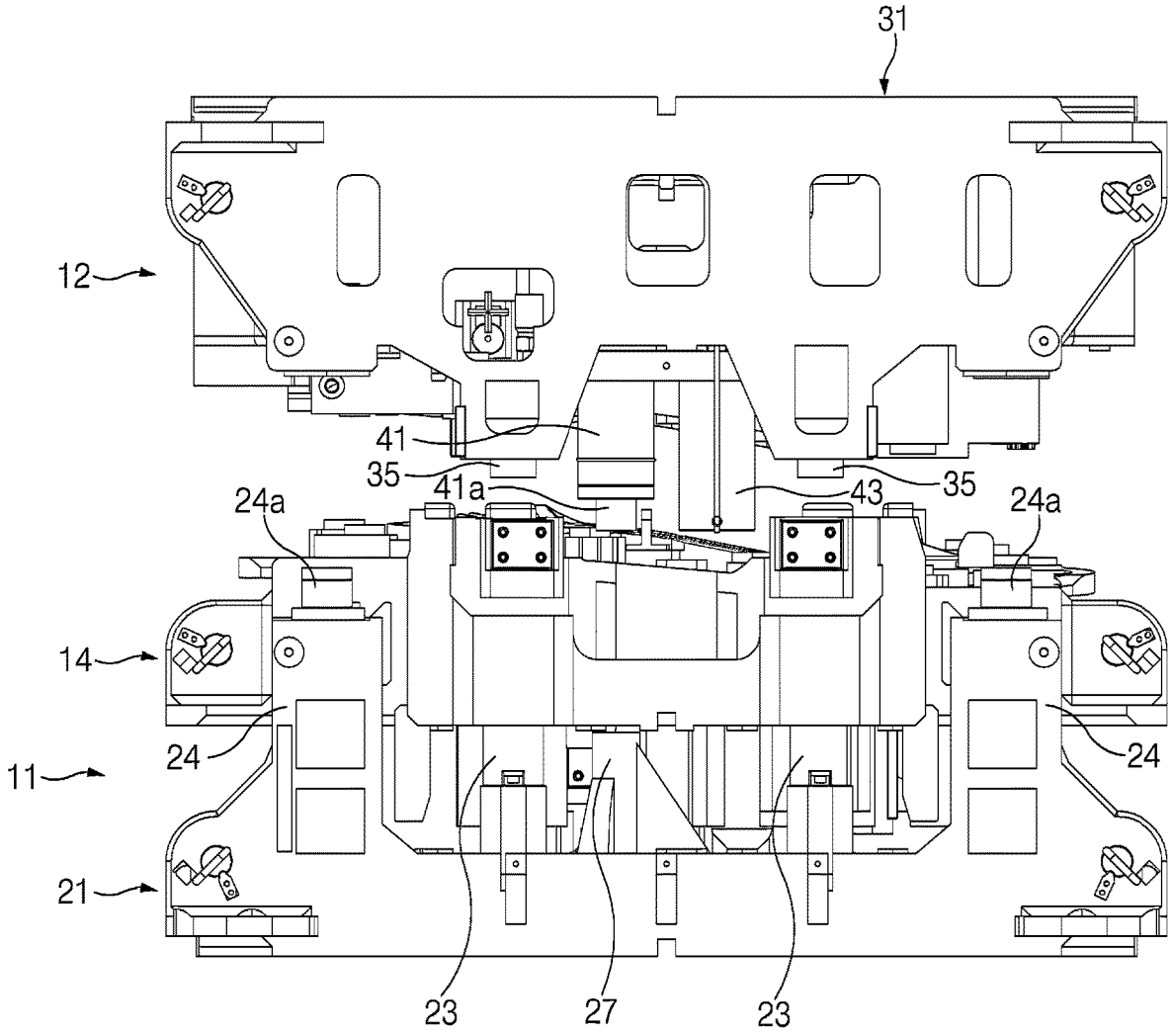
FIG. 19 is a view illustrating a process in which the upper die assembly moves upward from the lower die assembly in the press forming apparatus according to one embodiment of the present disclosure.

Referring to FIG. 10, the blank holder 14 may have an opening 14*a* formed in a central portion of the blank holder 14, and the lower die 22 may pass through the opening 14*a*. The blank holder 14 may be disposed to surround the lower die 22. Referring to FIG. 18, when the upper die assembly 12 and the lower die assembly 11 are closed, the blank holder 14 may move vertically downward by being pushed by the upper die assembly 12. Referring to FIG. 19, when the upper die assembly 12 moves upward away from the lower die assembly 11, the blank holder 14 may be returned to an original position by a non-illustrated biasing member.

Referring to FIG. 10, the lower die base 21 may include a plurality of guide rods 26 configured to guide a vertical movement of the blank holder 14.

Figure 11:
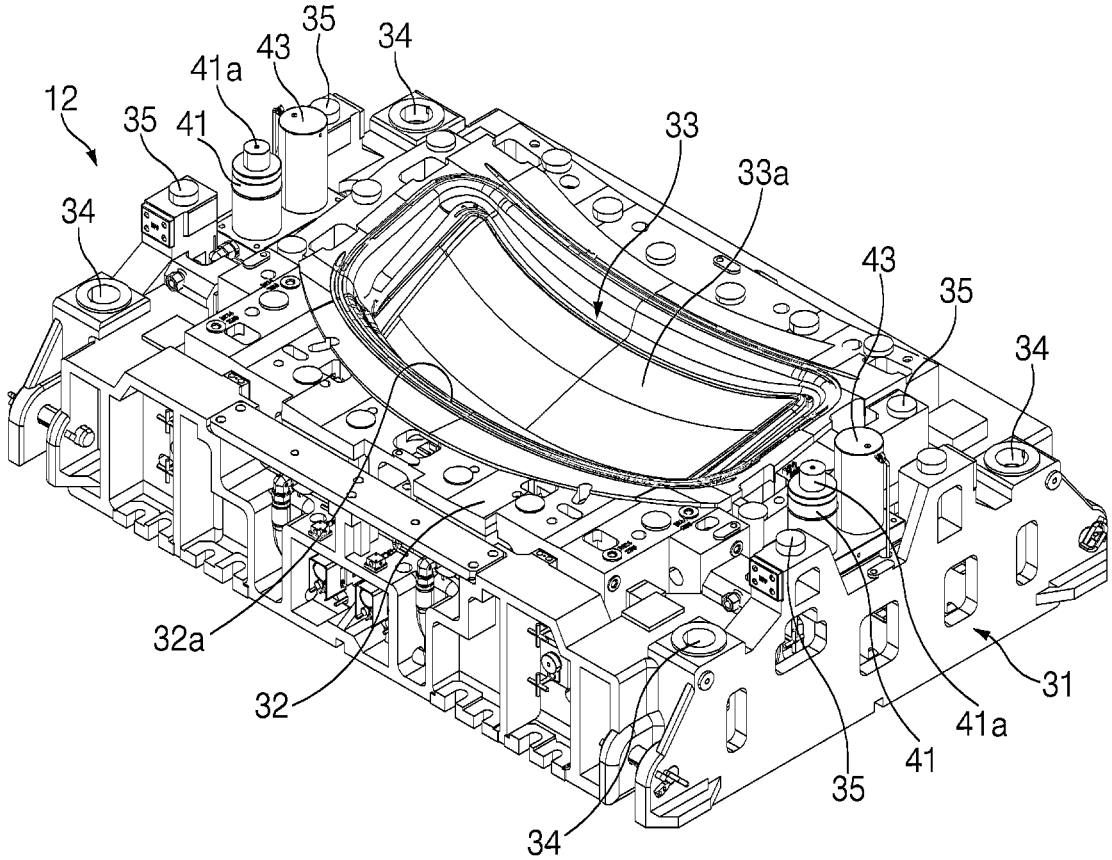
FIG. 11 is a perspective view illustrate a state in which the upper die assembly of the press forming apparatus according to one embodiment of the present disclosure is reversed upside down.
Figure 12:
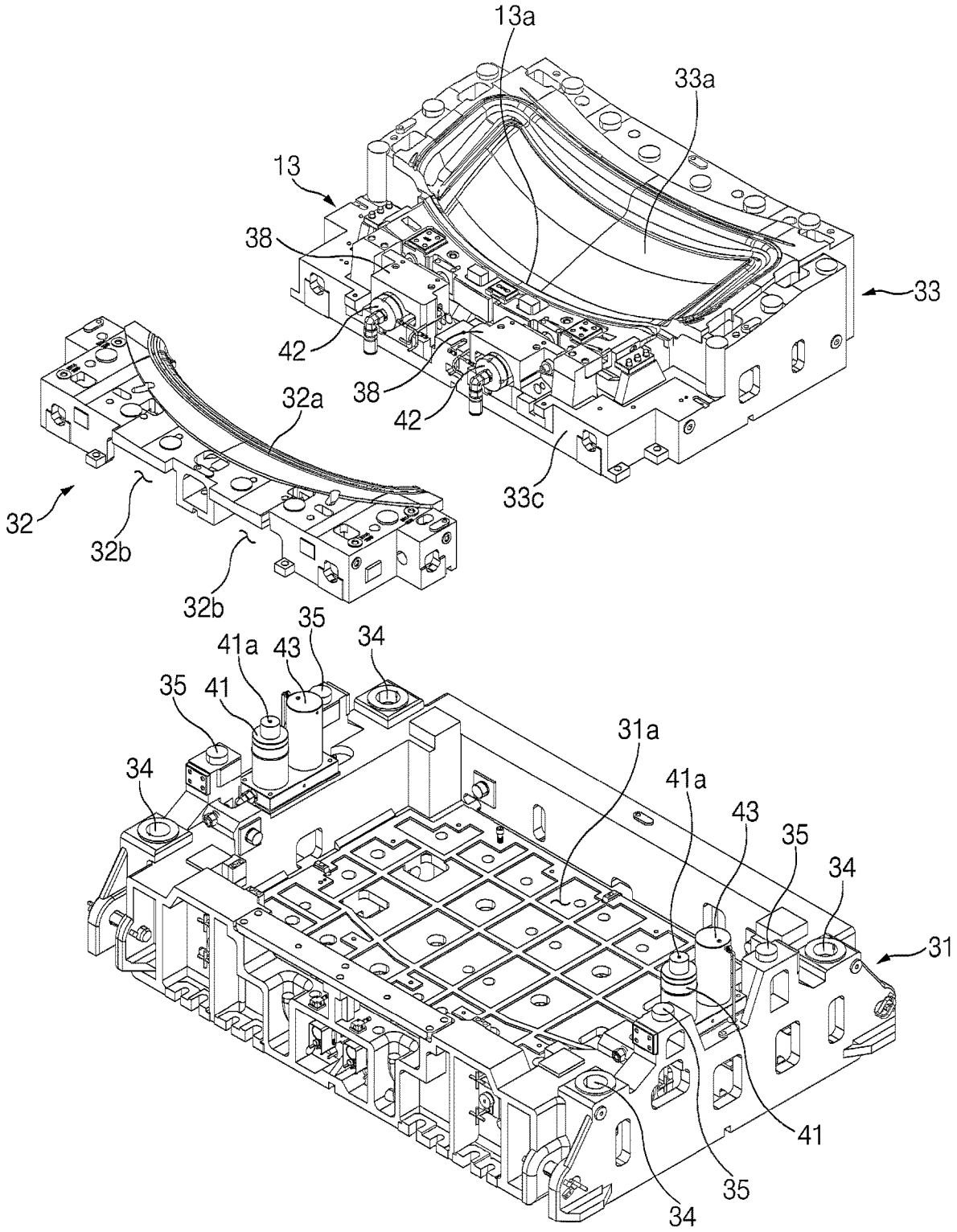
FIG. 12 is an exploded perspective view illustrating a state in which an upper die housing, the upper die, and the cam guide of the upper die assembly illustrated in FIG. 11 are separated.

FIG. 11 is a perspective view illustrating the upper die assembly 12 that is reversed upside down, and FIG. 12 is an exploded perspective view illustrating a state in which the upper die assembly 12 illustrated in FIG. 11 is disassembled.

Figure 17:
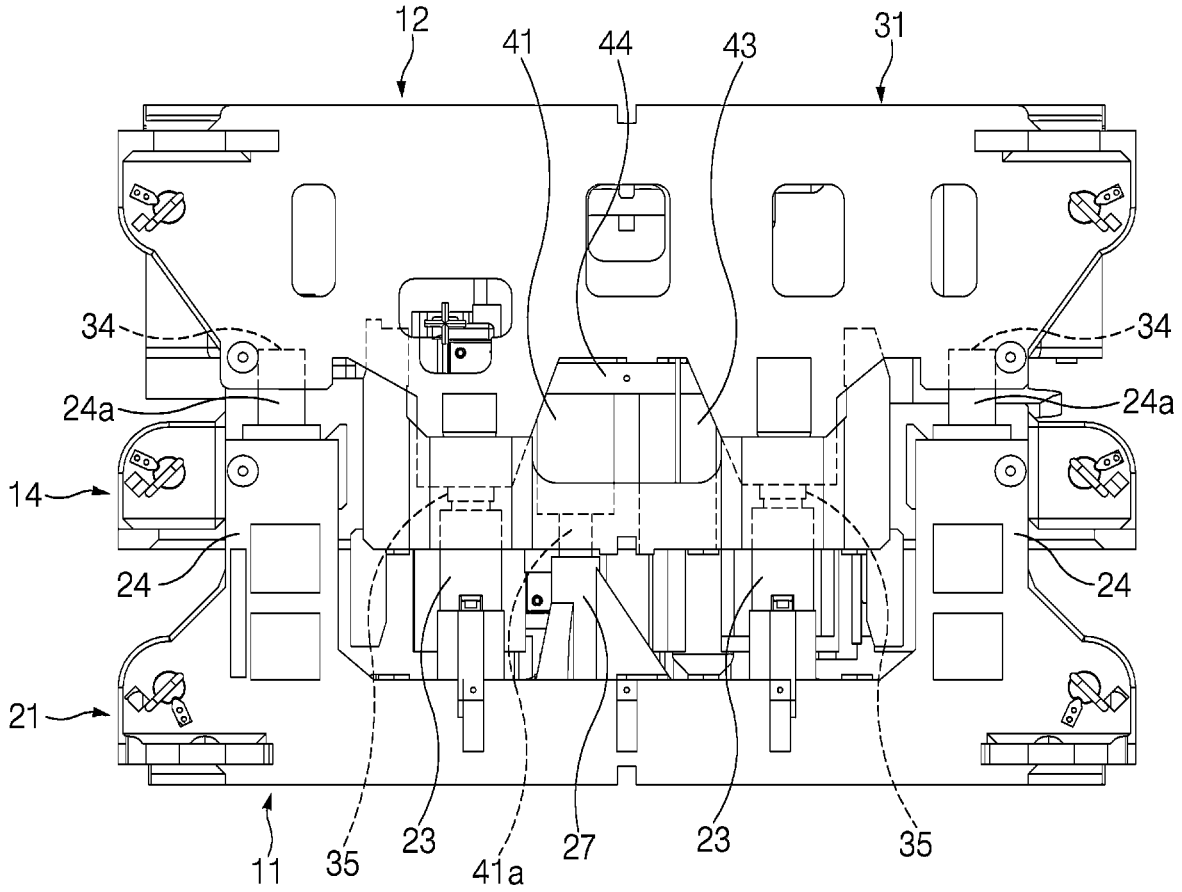
FIG. 17 is a view illustrating a process in which the upper die assembly moves downward toward the lower die assembly in the press forming apparatus according to one embodiment of the present disclosure.

Referring to FIG. 11, the upper die housing 31 may have a plurality of guide holes 34 provided at the edges of the upper die housing 31. The guide holes 34 may each accommodate the guide 24*a* of the lower die base 21. As illustrated in FIGS. 17 and 18, the guides 24*a* of the lower die base 21 may be accommodated in the guide holes 34*a* of the upper die housing 31 when the upper die assembly 12 moves toward the lower die assembly 11, such that the downward movement of the upper die assembly 12 relative to the lower die assembly 11 may be accurately guided.

Referring to FIG. 12, the upper die housing 31 may have a cavity 31*a* that accommodates the upper die 33, the cam guide 32, and the cam slider 13. Therefore, the upper die 33, the cam guide 32, and the cam slider 13 may be stably mounted in the cavity 31*a* of the upper die housing 31.

Referring to FIGS. 11 and 12, the upper die housing 31 may have a plurality of protrusions 35 provided at the edges of the upper die housing 31. Referring to FIG. 18, when the upper die assembly 12 and the lower die assembly 11 are closed, the protrusions 35 of the upper die assembly 12 may push the rods 23*a* of the gas springs 23 of the lower die assembly 11, such that the gas contained in the gas springs 23 may absorb the impact that may occur when the upper die assembly 12 and the lower die assembly 11 are closed.

Referring to FIG. 12, the upper die 33 may have a mounting portion 33*c*, and the cam slider 13 and the cam guide 32 may be mounted on the mounting portion 33*c*. The cam slider 13 may be configured to move in the second direction H on the mounting portion 33*c*, and the cam guide 32 may be mounted on the mounting portion 33*c* of the upper die 33 so as to cover the cam slider 13. Therefore, the movement of the cam slider 13 may be guided by the cam guide 32 and the mounting portion 33*c* of the upper die 33.

Referring to FIG. 12, the power cylinders 41 of the conversion mechanism 40 may be disposed on the upper die housing 31. For example, two power cylinders 41 may be respectively disposed at the edges of the upper die housing 31 that face each other. The cam slider 13 may be disposed adjacent to the first pressing surface 33*a* of the upper die 33. The force cylinders 42 of the conversion mechanism 40 may be disposed adjacent to the cam slider 13. The force cylinders 42 may be positioned at a side opposite to the second pressing surface 13*a* of the cam slider 13. Therefore, the force cylinder 42 may be configured to push the cam slider 13 toward the lower die 22. The force cylinders 42 may be mounted on the mounting portion 33*c* of the upper die 33 by means of mounting blocks 38. The cam guide 32 may have openings 32*b* that accommodate the mounting blocks 38.

Figure 13:
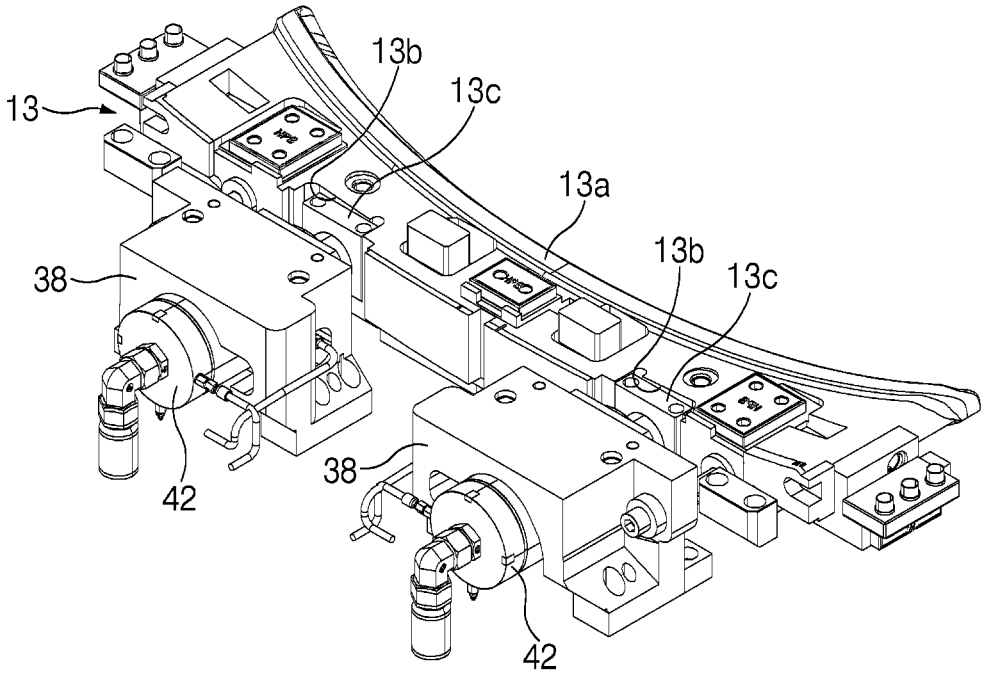
FIG. 13 is a perspective view illustrating the cam slider of the press forming apparatus according to one embodiment of the present disclosure.
Figure 14:
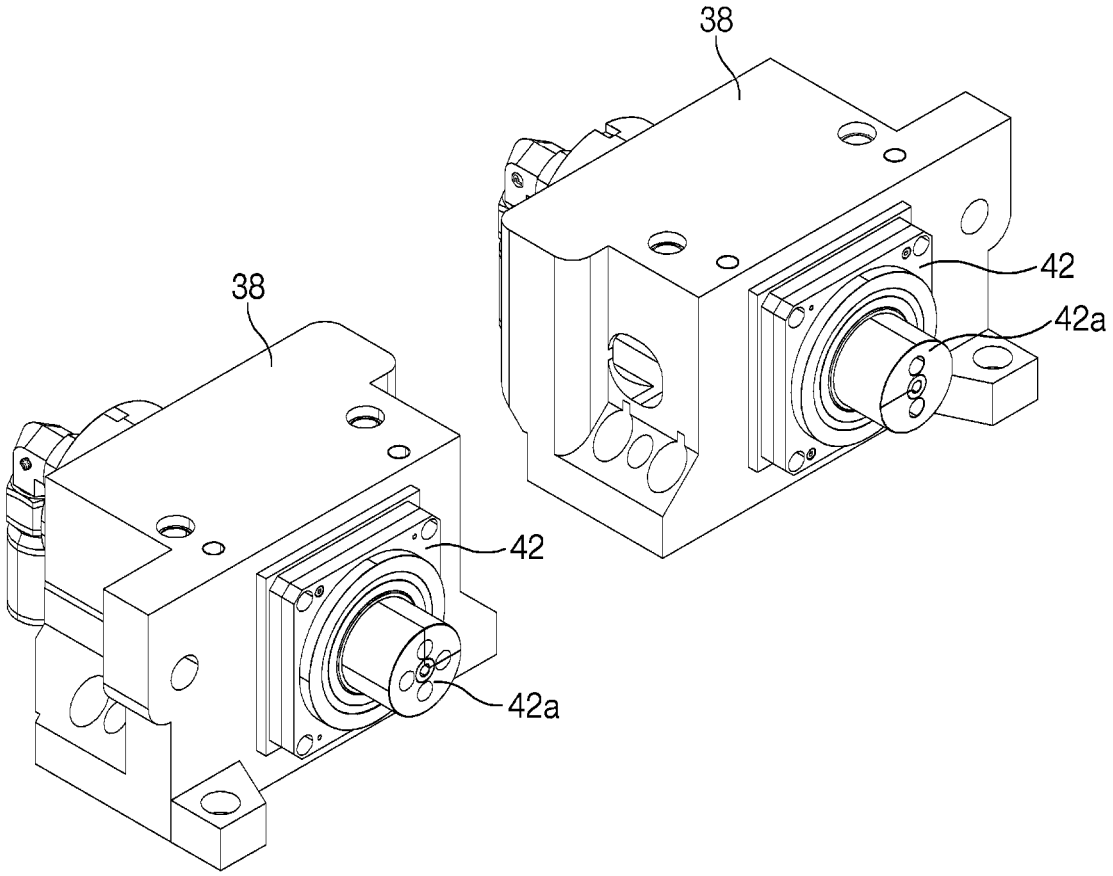
FIG. 14 is a view illustrating a state in which a force cylinder is accommodated and supported in a mounting block in the press forming apparatus according to one embodiment of the present disclosure.

Referring to FIGS. 12 and 13, two force cylinders 42 may be disposed to push the cam slider 13. The two force cylinders 42 may be separately mounted on the mounting portion 33*c* of the upper die 33 by means of two mounting blocks 38. The mounting blocks 38 may be respectively accommodated and mounted in the openings 32*b* of the cam guide 32. Referring to FIG. 14, the force cylinders 42 may be respectively accommodated and supported in openings of the corresponding mounting blocks 38.

Referring to FIG. 13, the cam slider 13 may have grooves 13*b* provided at a side opposite to the second pressing surface 13*a*, and pads 13*c* may be fixed to the grooves 13*b*. The pad 13*c* may be aligned with the force-side rod 42*a* of the force cylinder 42. The force-side rod 42*a* may come into contact with and press the pad 13*c*. The pad 13*c* may have a flat surface orthogonal to a longitudinal axis of the force cylinder 42. When the force-side rod 42*a* of the force cylinder 42 is advanced, the force-side rod 42*a* may push the pad 13*c*, such that the cam slider 13 may move toward the lower die 22. Because the force-side rod 42*a* of the force cylinder 42 is configured to press the pad 13*c*, it is possible to inhibit or prevent an overload from being applied to the force-side rod 42*a* of the force cylinder 42 and prevent the cam slider 13 from being abraded.

Figure 15:
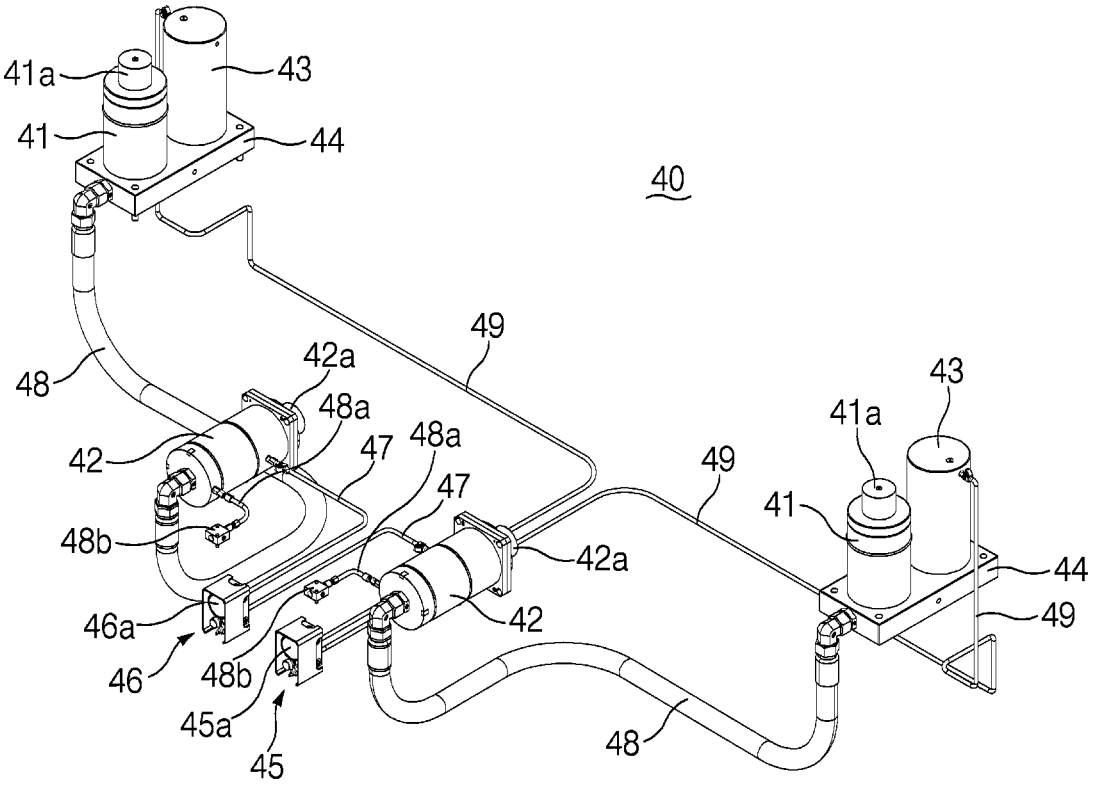
FIG. 15 is a view illustrating a conversion mechanism of the press forming apparatus according to one embodiment of the present disclosure.

FIG. 15 is a view illustrating the conversion mechanism 40. Referring to FIG. 15, the conversion mechanism 40 may include the two power cylinders 41 and the two force cylinders 42. The two power cylinders 41 may be respectively connected to the two force cylinders 42 through two hydraulic conduits 48. The power cylinders 41 may each be hydraulically connected to the corresponding force cylinder 42 through the corresponding hydraulic conduit 48.

Referring to FIG. 15, the conversion mechanism 40 may further include tanks 43 hydraulically connected to the power cylinders 41. The two tanks 43 may be respectively connected to the two power cylinders 41. The tanks 43, together with the corresponding power cylinders 41, may be respectively supported by support blocks 44.

The support blocks 44 may be fixed to one side edge of the upper die housing 31 of the upper die assembly 12. The power cylinders 41 and the tanks 43 may be mounted on the upper die housing 31 through the support blocks 44.

Figure 16:
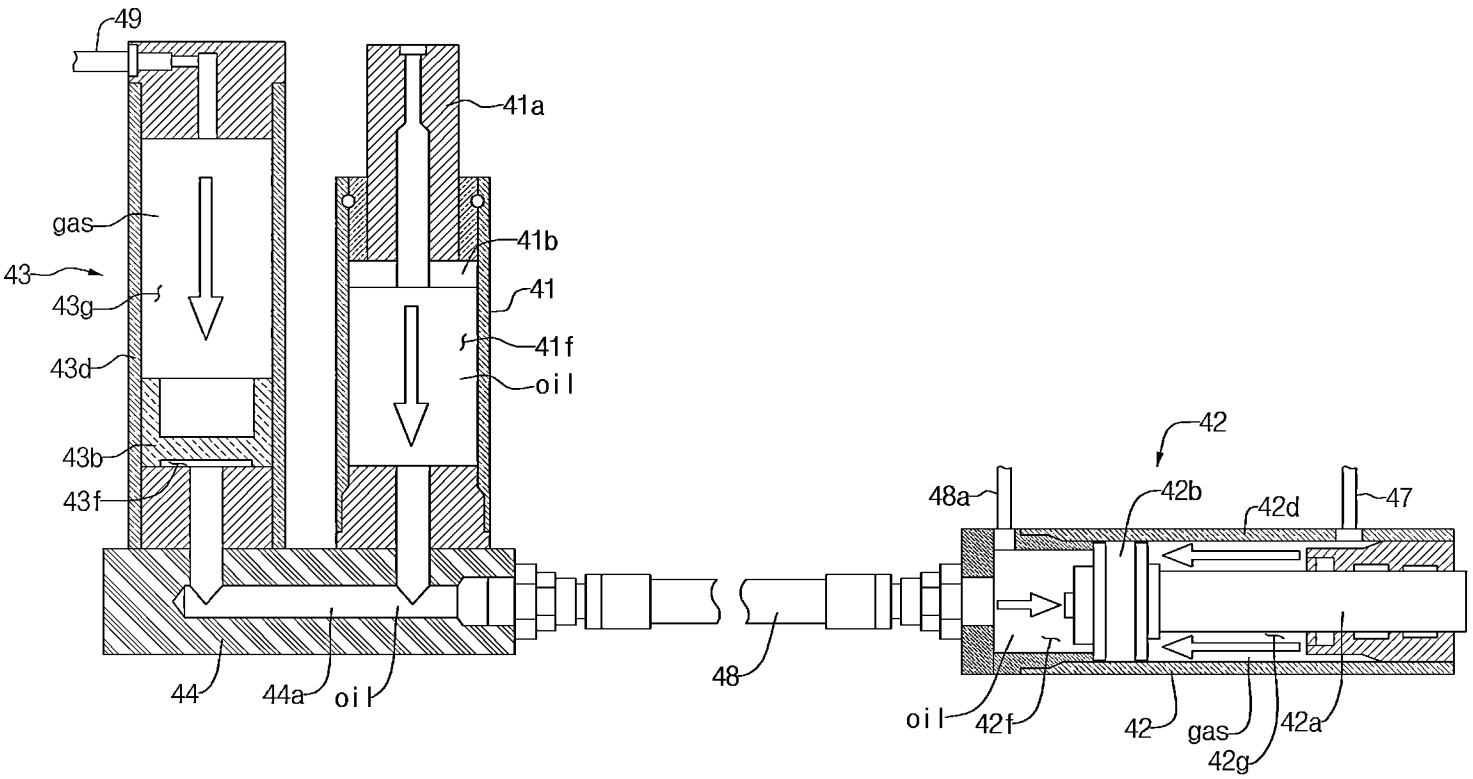
FIG. 16 is a configuration view illustrating connection between a power cylinder, the force cylinder, and a tank of the conversion mechanism of the press forming apparatus according to one embodiment of the present disclosure.

Referring to FIG. 16, the support block 44 may have a hydraulic passageway 44*a* defined therein. The hydraulic passageway 44*a* of the support block 44 may communicate directly with the hydraulic conduit 48, a tank-side hydraulic chamber 43*f*, and a power-side hydraulic chamber 41*f* of the power cylinder 41. A force-side hydraulic chamber 42*f* of the force cylinder 42 may communicate with the power-side hydraulic chamber 41*f* of the power cylinder 41 through the hydraulic conduit 48 and the hydraulic passageway 44*a*. Therefore, the hydraulic fluid such as oil may flow between the force-side hydraulic chamber 42*f* of the force cylinder 42 and the power-side hydraulic chamber 41*f* of the power cylinder 41. The power-side hydraulic chamber 41*f* of the power cylinder 41 may communicate with the tank-side hydraulic chamber 43*f* of the tank 43 through the hydraulic passageway 44*a*. Therefore, the hydraulic fluid may flow between the power-side hydraulic chamber 41*f* of the power cylinder 41 and the tank-side hydraulic chamber 43*f* of the tank 43.

Referring to FIG. 16, the power cylinder 41 may include a cylinder barrel 41*d* having the power-side hydraulic chamber 41*f*, and a power-side piston 41*b* configured to be movable in the cylinder barrel 41*d*. The power-side rod 41*a* may be connected to the power-side piston 41*b*. The power-side hydraulic chamber 41*f* may be defined by an inner surface of the cylinder barrel 41*d* and the power-side piston 41*b*. The power-side hydraulic chamber 41*f* may contain the hydraulic fluid such as oil.

Referring to FIG. 16, the force cylinder 42 may include a cylinder barrel 42*d* having the force-side hydraulic chamber 42*f* and a force-side gas chamber 42*g*, and a force-side piston 42*b* configured to be movable in the cylinder barrel 42*d*. The force-side rod 42*a* may be connected to the force-side piston 42*b*. The force-side hydraulic chamber 42*f* and the force-side gas chamber 42*g* may be separated in the cylinder barrel 42*d* by the force-side piston 42*b*. The force-side hydraulic chamber 42*f* may contain the hydraulic fluid. The force-side gas chamber 42*g* may contain compressed gas such as $N_2$. The force-side gas chamber 42*g* may be filled with the gas at a predetermined first pressure. The gas contained in the force-side gas chamber 42*g* may apply the first pressure and push the force-side piston 42*b* toward the hydraulic conduit 48. The gas contained in the force-side gas chamber 42*g* may apply the first pressure and push the force-side piston 42*b* toward the hydraulic conduit 48, thereby providing a biasing force that biases the force-side rod 42*a* to the retracted position. That is, the first pressure may be a pressure that provides the biasing force that biases the force-side rod 42*a* to the retracted position. For example, the first pressure in the force-side gas chamber 42*g* may be about 20 bar. Because the gas contained in the force-side gas chamber 42*g* provides the biasing force that retracts the force-side rod 42*a* as described above, the force-side rod 42*a* may be easily returned to the retracted position after the force-side rod 42*a* is advanced.

Referring to FIG. 16, a force-side gas conduit 47 may be connected to the force-side gas chamber 42*g*. The force-side gas chamber 42*g* may be filled with the gas through the force-side gas conduit 47 from a gas supply source. Referring to FIG. 15, a force-side control block 46 may be connected to the force-side gas chamber 42*g* through the force-side gas conduit 47. The force-side control block 46 may include a pressure gauge 45*a* configured to check the first pressure in the force-side gas chamber 42*g*. In addition, the force-side control block 46 may include a valve (not illustrated) configured to adjust the amount or the first pressure of the gas contained in the force-side gas chamber 42*g*. An operator may check a pressure of the gas by using the pressure gauge 46*a* of the force-side control block 46 when the gas is contained in the force-side gas chamber 42*g* from the gas supply source. Therefore, the operator may accurately set the pressure in the force-side gas chamber 42*g* to the predetermined first pressure, such that the force-side rod 42*a* may be accurately returned to the retracted position by the first pressure after the force-side rod 42*a* is advanced.

Referring to FIG. 16, the tank 43 may include a tank body 43*d* having the tank-side hydraulic chamber 43*f* and a tank-side gas chamber 43*g*, and a floating piston 43*b* configured to be movable in the tank body 43*d*. The tank-side hydraulic chamber 43*f* and the tank-side gas chamber 43*g* may be separated in the tank body 43*d* by the floating piston 43*b*. The tank-side hydraulic chamber 43*f* may contain the hydraulic fluid. The tank-side gas chamber 43*g* may contain gas. The tank-side gas chamber 43*g* may be filled with the gas at a predetermined second pressure. The gas contained in the tank-side gas chamber 43*g* may push the floating piston 43*b* toward the hydraulic passageway 44*a*. Therefore, as the gas contained in the tank-side gas chamber 43*g* pushes the floating piston 43*b* toward the hydraulic passageway 44*a*, the hydraulic fluid contained in the tank-side hydraulic passageway 44*a* may flow to the power-side hydraulic chamber 41*f* through the hydraulic conduit 48, such that the amount of hydraulic fluid contained in the power-side hydraulic chamber 41*f* may relatively increase. Therefore, the hydraulic fluid contained in the power-side hydraulic chamber 41*f* may push the power-side piston 41*b* in a direction opposite to the hydraulic passageway 44*a*, such that the power-side rod 41*a* may be advanced from the cylinder barrel 41*d*. The second pressure of the gas contained in the tank-side gas chamber 43*g* may provide a biasing force that biases the power-side rod 41*a* to the advanced position. That is, the second pressure may be a pressure that provides the biasing force that biases the power-side rod 41*a* to the advanced position. Because the second pressure of the gas contained in the tank-side gas chamber 43*g* provides the biasing force that biases the power-side rod 41*a* to the advanced position as described above, the power-side rod 41*a* may be easily returned to the advanced position after an external force applied to the power-side rod 41*a* is eliminated. The gas contained in the tank-side gas chamber 43*g* does not directly push the power-side piston 41*b*, but the gas contained in the tank-side gas chamber 43*g* indirectly pushes the power-side piston 41*b* through the hydraulic fluid and the floating piston 43*b* of the tank 43. Therefore, the second pressure is relatively higher than the first pressure. For example, the second pressure may be about 150 bar.

Referring to FIG. 16, a tank-side gas conduit 49 may be connected to the tank-side gas chamber 43*g*. The tank-side gas chamber 43*g* may be filled with the gas through the tank-side gas conduit 49 from a gas supply source. Referring to FIG. 15, a tank-side control block 45 may be connected to the tank-side gas chamber 43*g* through the tank-side gas conduit 49. The tank-side control block 45 may include a pressure gauge 45*a* configured to check the second pressure in the tank-side gas chamber 43*g*. In addition, the tank-side control block 45 may include a valve (not illustrated) configured to adjust the amount or the second pressure of the gas contained in the tank-side gas chamber 43*g*. The operator may check the pressure of the gas by using the pressure gauge 45*a* of the tank-side control block 45 when the gas is contained in the tank-side gas chamber 43*g* from the gas supply source. Therefore, the operator may set the pressure in the tank-side gas chamber 43*g* to the predetermined second pressure, such that the power-side rod 41*a* may be accurately returned to the advanced position by the second pressure after an external force applied to the power-side rod 41*a* of the power cylinder 41 is eliminated.

Referring to FIG. 16, a hydraulic fluid supply conduit 48*a* may be connected to the force-side hydraulic chamber 42*f* of the force cylinder 42. The hydraulic fluid may be supplied and contained in the force-side hydraulic chamber 42*f*, the hydraulic conduit 48, the hydraulic passageway 44*a*, and the power-side hydraulic chamber 41*f* through the hydraulic fluid supply conduit 48*a* from a supply source. A coupling block 48*b* may be connected to the hydraulic fluid supply conduit 48*a*. The coupling block 48*b* may be connected to a supply conduit extending from the supply source. The coupling block 48*b* may be configured to remove air from the hydraulic fluid when the hydraulic fluid is contained in the force-side hydraulic chamber 42*f* and the power-side hydraulic chamber 41*f* through the hydraulic fluid supply conduit 48*a* from the supply source. For example, the coupling block 48*b* may have an air removing structure such as an air vent valve. Because the coupling block 48*b* removes air from the hydraulic fluid when the hydraulic fluid is contained in the force-side hydraulic chamber 42*f* and the power-side hydraulic chamber 41*f* as described above, the hydraulic fluid may more smoothly flow, and the movement of the force-side rod by the flow of the hydraulic fluid may be stably ensured.

The hydraulic conduit 48, the hydraulic fluid supply conduit 48*a*, the force-side gas conduit 47, and the tank-side gas conduit 49 may be embedded in the upper die assembly 12.

As the upper die assembly 12 moves downward toward the lower die assembly 11, the power-side rod 41*a* of the power cylinder 41 may be pressed by a portion of the lower die assembly 11, such that the power-side rod 41*a* may be retracted, and the hydraulic fluid contained in the power-side hydraulic chamber 41*f* of the power cylinder 41 may be transmitted to the force-side hydraulic chamber 42*f* of the force cylinder 42 through the hydraulic conduit 48. Therefore, the hydraulic fluid may push the force-side rod 42*a* of the force cylinder 42 toward the cam slider 13, such that the cam slider 13 may move toward the lower die 22.

Referring to FIG. 17, the guides 24*a* of the lower die assembly 11 may be accommodated in the guide holes 34 of the upper die assembly 12 when the upper die assembly 12 moves downward toward the lower die assembly 11, such that the downward movement of the upper die assembly 12 may be accurately guided relative to the lower die assembly 11. In this case, lower ends of the power-side rods 41*a* of the power cylinders 41 come into contact with upper surfaces of the push members 27 of the lower die assembly 11, and the protrusions 35 of the upper die assembly 12 come into contact with the rods 23*a* of the gas springs 23 of the lower die assembly 11.

Referring to FIG. 18, as the upper die assembly 12 is completely moved downward toward the lower die assembly 11, the upper die assembly 12 and the lower die assembly 11 may be closed, the guides 24*a* of the lower die assembly 11 may be completely accommodated in the guide holes 34 of the upper die assembly 12, and the power-side rods 41*a* of the power cylinders 41 may be retracted by being pushed by the push members 27 of the lower die assembly 11. Further, the blank holder 14 may be moved downward by being pushed by the upper die assembly 12, the rods 23*a* of the gas springs 23 of the lower assembly 11 may be retracted into the cylinders of the gas springs 23 of the lower die assembly 11 by being pushed by the protrusions 35 of the upper die assembly 12, such that the gas springs 23 may lessen the impact that occurs when the upper die assembly 12 and the lower die assembly 11 are closed.

Referring to FIG. 19, as the upper die assembly 12 moves upward, the upper die assembly 12 may move away from the lower die assembly 11, the power-side rod 41*a* of the power cylinder 41 may be returned to the advanced position, and the blank holder 14 may be returned to the original position.

Figure 20:
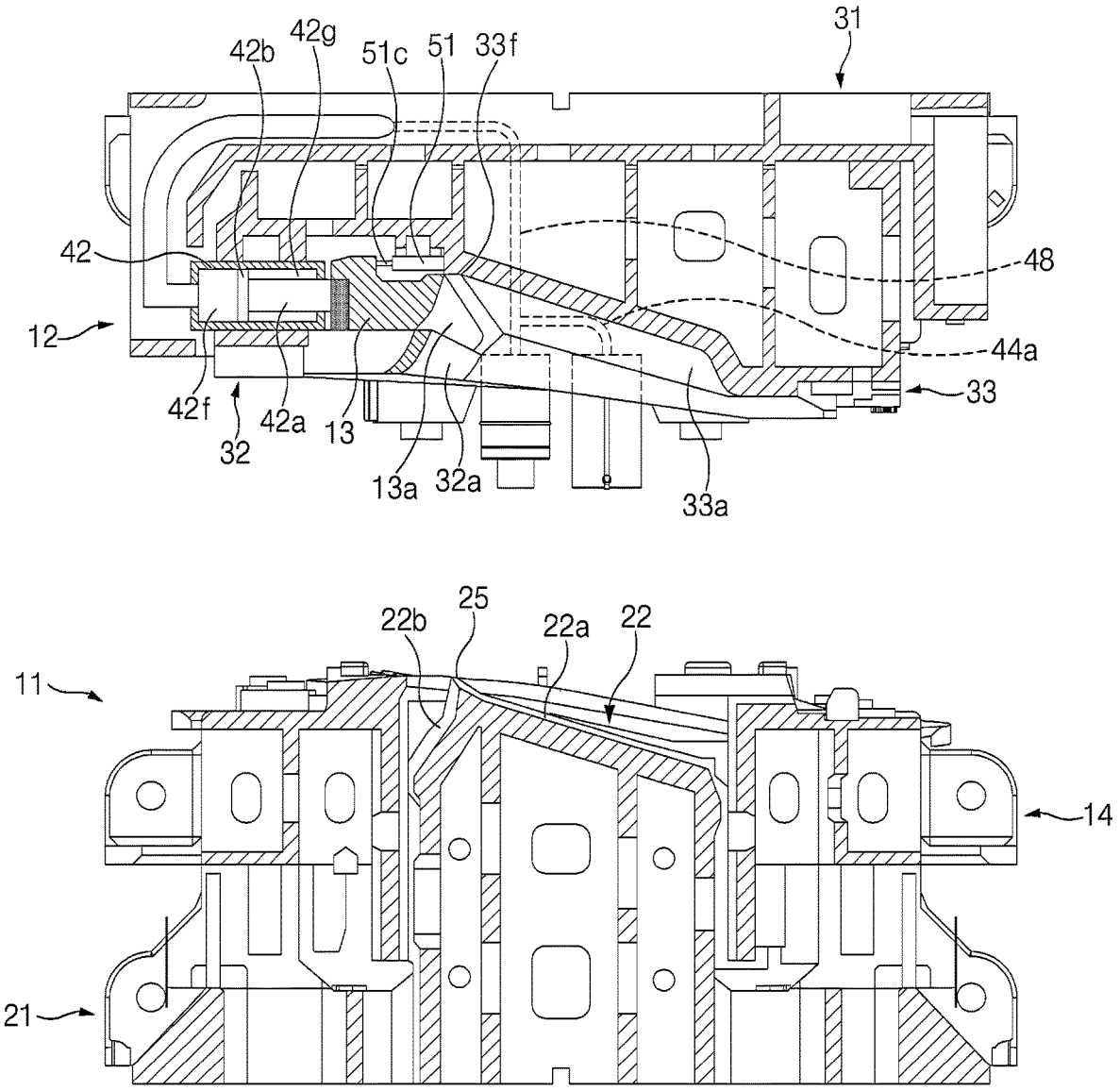
FIG. 20 is a cross-sectional view taken along line B-B in FIG. 9.

Referring to FIG. 20, when the upper die assembly 12 moves away from the lower die assembly 11, the power-side rod 41*a* of the power cylinder 41 is positioned at the advanced position, and the force-side rod 42*a* of the force cylinder 42 is positioned at the retracted position.

Figure 21:
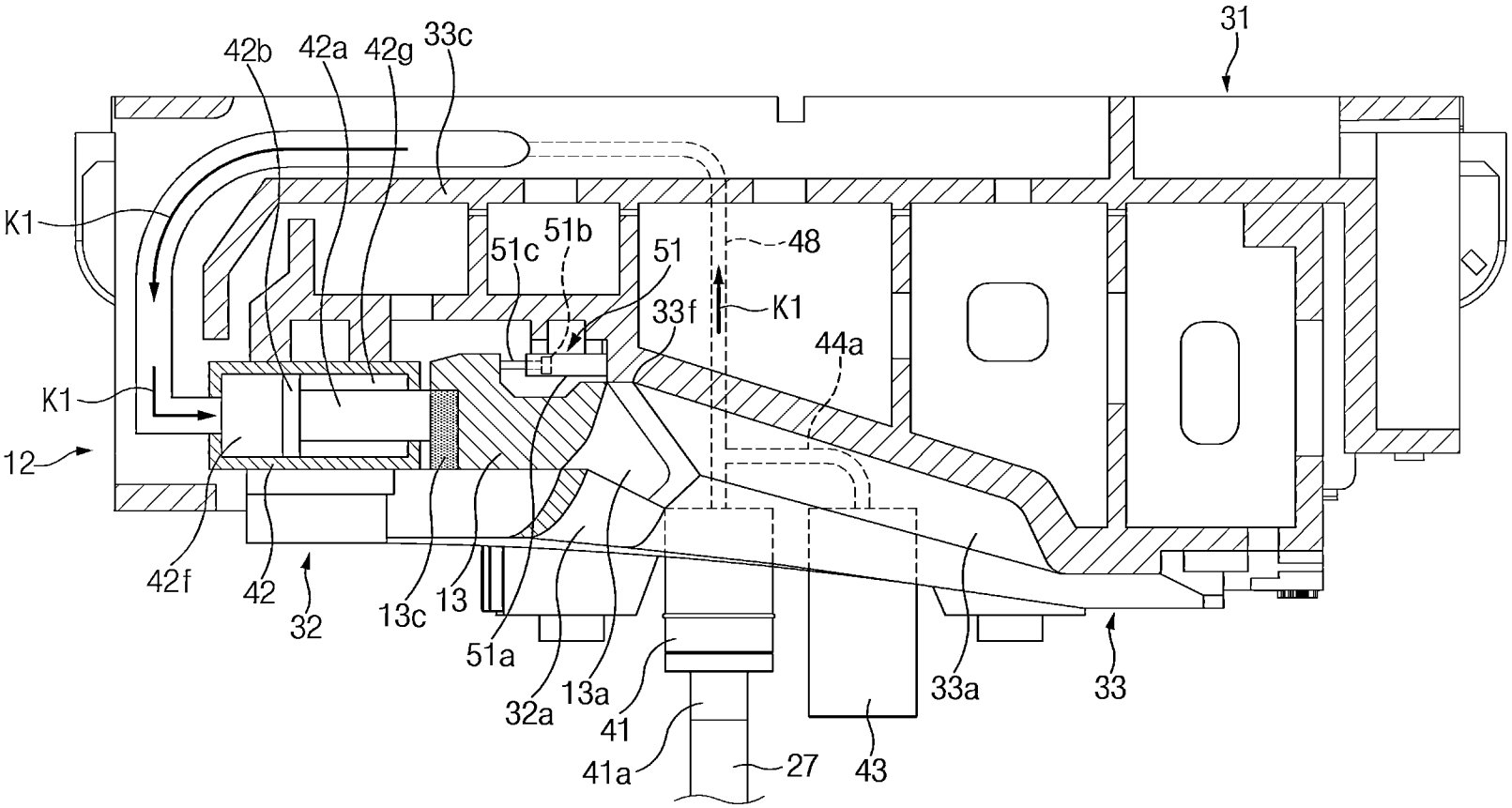
FIG. 21 is a view illustrating a process in which a power-side rod of a power cylinder comes into contact with a push member when the upper die assembly moves downward in the press forming apparatus according to one embodiment of the present disclosure.
Figure 22:
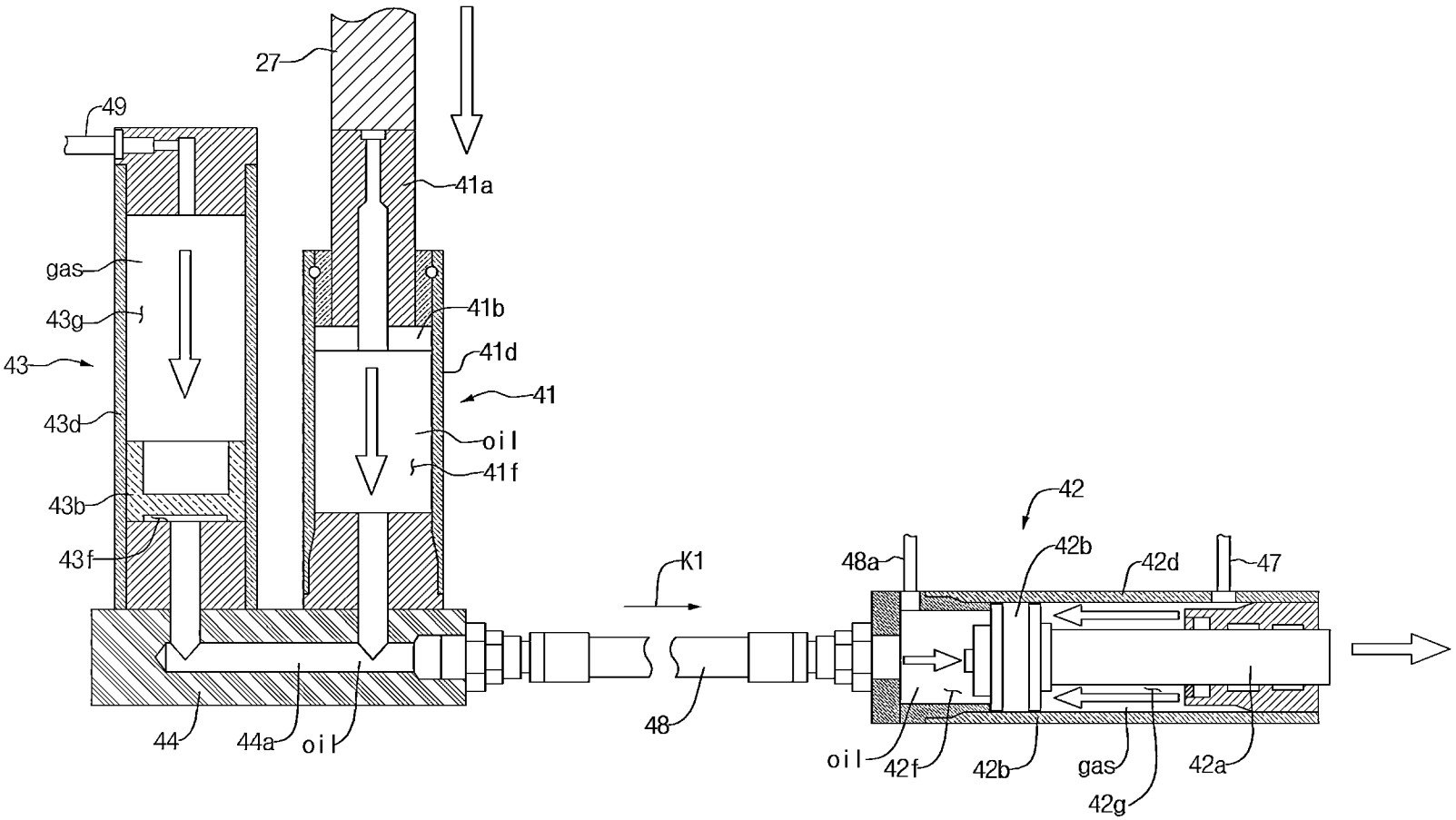
FIG. 22 is a view illustrating a process in which a hydraulic fluid contained in a power-side hydraulic chamber flows into a force-side hydraulic chamber when the power-side rod of the power cylinder begins to come into contact with the push member in the press forming apparatus according to one embodiment of the present disclosure.

When the upper die assembly 12 moves downward toward the lower die assembly 11, the power-side rod 41*a* of the power cylinder 41 begins to come into contact with the push member 27, as illustrated in FIG. 21. Further, as illustrated in FIG. 22, the power-side rod 41*a* of the power cylinder 41 begins to be retracted by being pushed by the push member 27. When the power-side rod 41*a* begins to be retracted, the hydraulic fluid contained in the power-side hydraulic chamber 41*f* may flow into the force-side hydraulic chamber 42*f* (see arrow K1), the amount of hydraulic fluid contained in the force-side hydraulic chamber 42*f* may relatively increase, such that the hydraulic fluid may slowly push the force-side piston 42*b*, and the force-side rod 42*a* may be advanced from the cylinder barrel 42*d* of the force cylinder 42.

Figure 24:
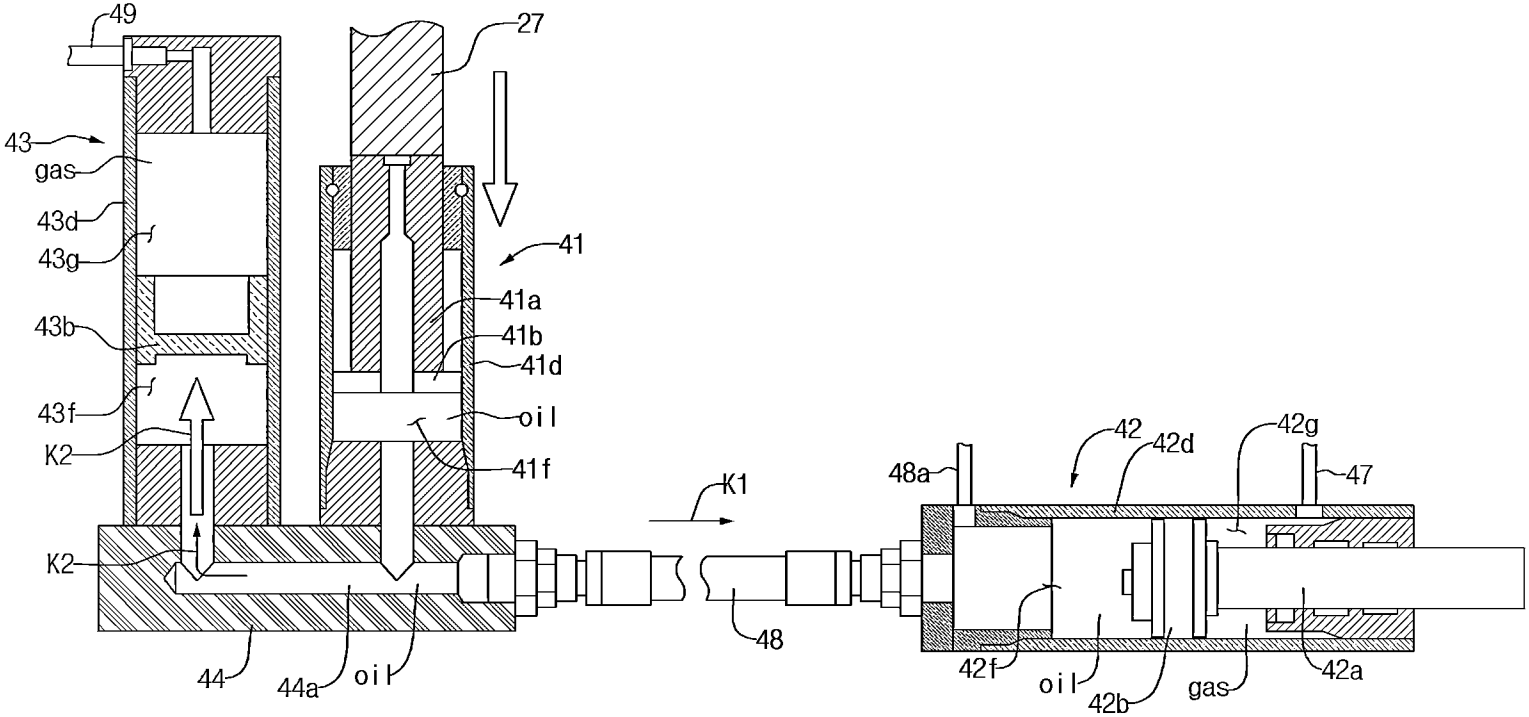
FIG. 24 is a view illustrating a process in which a portion of the hydraulic fluid contained in the power-side hydraulic chamber flows into the force-side hydraulic chamber, and the remaining portion of the hydraulic fluid contained in the power-side hydraulic chamber flows to a tank-side hydraulic chamber when the power-side rod of the power cylinder is completely retracted by being pushed by the push member in the press forming apparatus according to one embodiment of the present disclosure.

When the upper die assembly 12 and the lower die assembly 11 are closed as the upper die assembly 12 is completely moved toward the lower die assembly 11, the power-side rod 41*a* of the power cylinder 41 is completely retracted by being pushed by the push member 27, as illustrated in FIGS. 23 and 24. As the power-side rod 41*a* is completely retracted, the power-side piston 41*b* may push the hydraulic fluid contained in the power-side hydraulic chamber 41*f*. Therefore, a portion of the hydraulic fluid contained in the power-side hydraulic chamber 41*f* may completely flow into the force-side hydraulic chamber 42*f* of the force cylinder 42 through the hydraulic passageway 44*a* and the hydraulic conduit 48 (see arrow K1), and the remaining portion of the hydraulic fluid contained in the power-side hydraulic chamber 41*f* may flow to the tank-side hydraulic chamber 43*f* of the tank 43 (see arrow K2). Therefore, because the amount of hydraulic fluid contained in the force-side hydraulic chamber 42*f* maximally increases, the hydraulic fluid may completely push the force-side piston 42*b* toward the cam slider 13, such that the force-side rod 42*a* may be advanced from the cylinder barrel 42*d* of the force cylinder 42. Therefore, the force-side rod 42*a* may completely push the cam slider 13, such that the upper end edge of the cam slider 13 may come into contact with the upper edge 33*f* of the first pressing surface 33*a* of the upper die 33. As illustrated in FIGS. 3 and 7, the upper die 33, the cam slider 13, and the lower die 22 may press the workpiece W when the upper die assembly 12 and the lower die assembly 11 are closed, such that the workpiece W may be precisely formed in a designed shape of the component which is a target to be manufactured.

Figure 25:
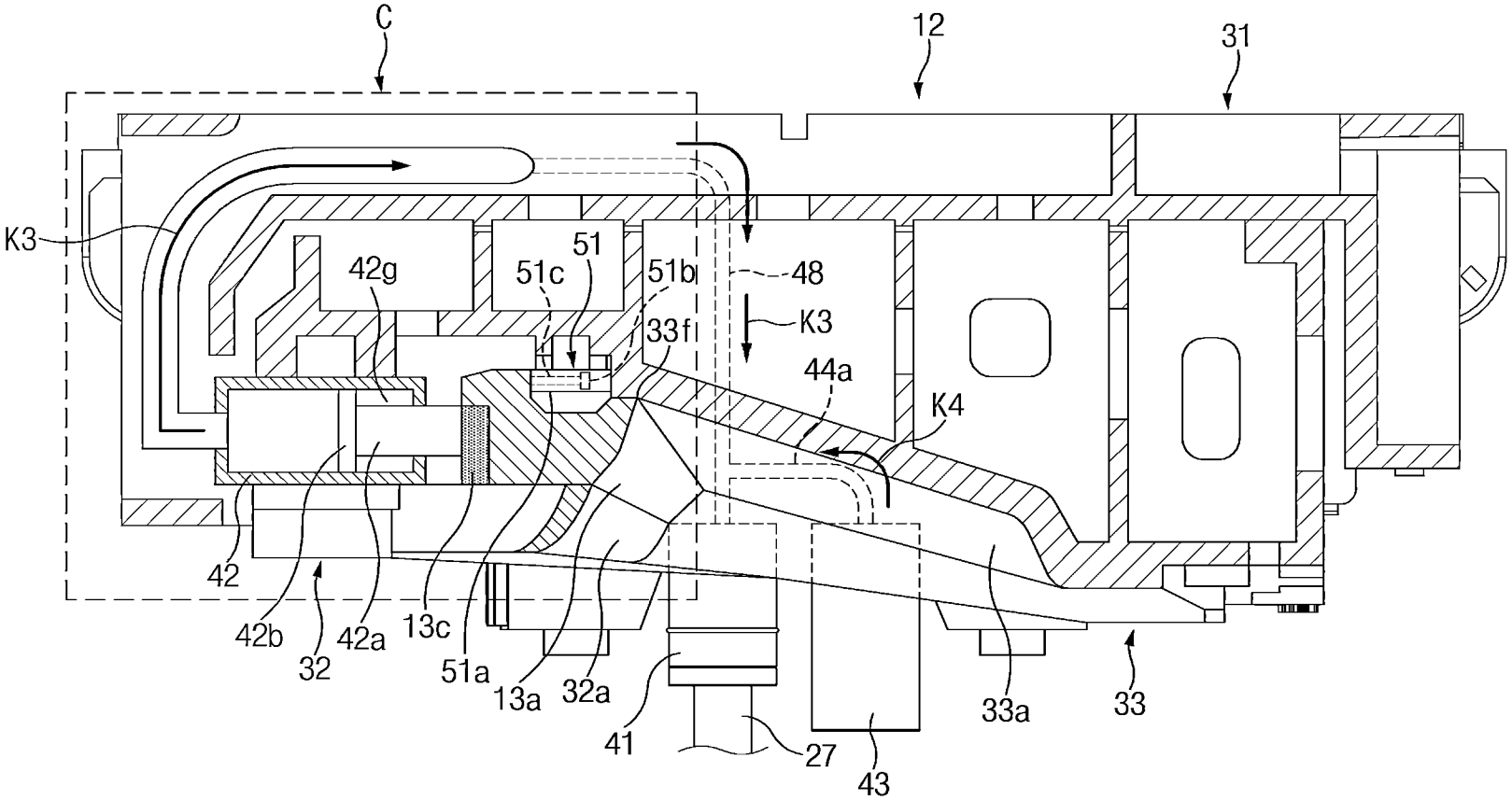
FIG. 25 is a view illustrating a process in which the hydraulic fluid begins to flow from the force cylinder to the power cylinder and the hydraulic fluid begins to flow from a tank to the power cylinder as an external force applied to the power-side rod of the power cylinder by the push member gradually decreases when the upper die assembly begins to move upward in the press forming apparatus according to one embodiment of the present disclosure.

After the workpiece is completely manufactured by the lower die assembly 11, the upper die assembly 12, and the cam slider 13, when the upper die assembly 12 begins to move upward from the lower die assembly 11, the external force applied to the power-side rod 41*a* by the push member 27 gradually decreases. Therefore, the pressure in the power-side hydraulic chamber 41*f* relatively decreases, such that the hydraulic fluid begins to flow from the force cylinder 42 to the power cylinder 41 (see arrow K3), and the hydraulic fluid begins to flow from the tank 43 to the power cylinder 41 (see arrow K4), as illustrated in FIG. 25. Specifically, the hydraulic fluid contained in the force-side hydraulic chamber 42*f* begins to flow to the power-side hydraulic chamber 41*f* (see arrow K3), and the hydraulic fluid contained in the tank-side hydraulic chamber 43*f* begins to flow to the power-side hydraulic chamber 41*f* (see arrow K4).

Figure 26:
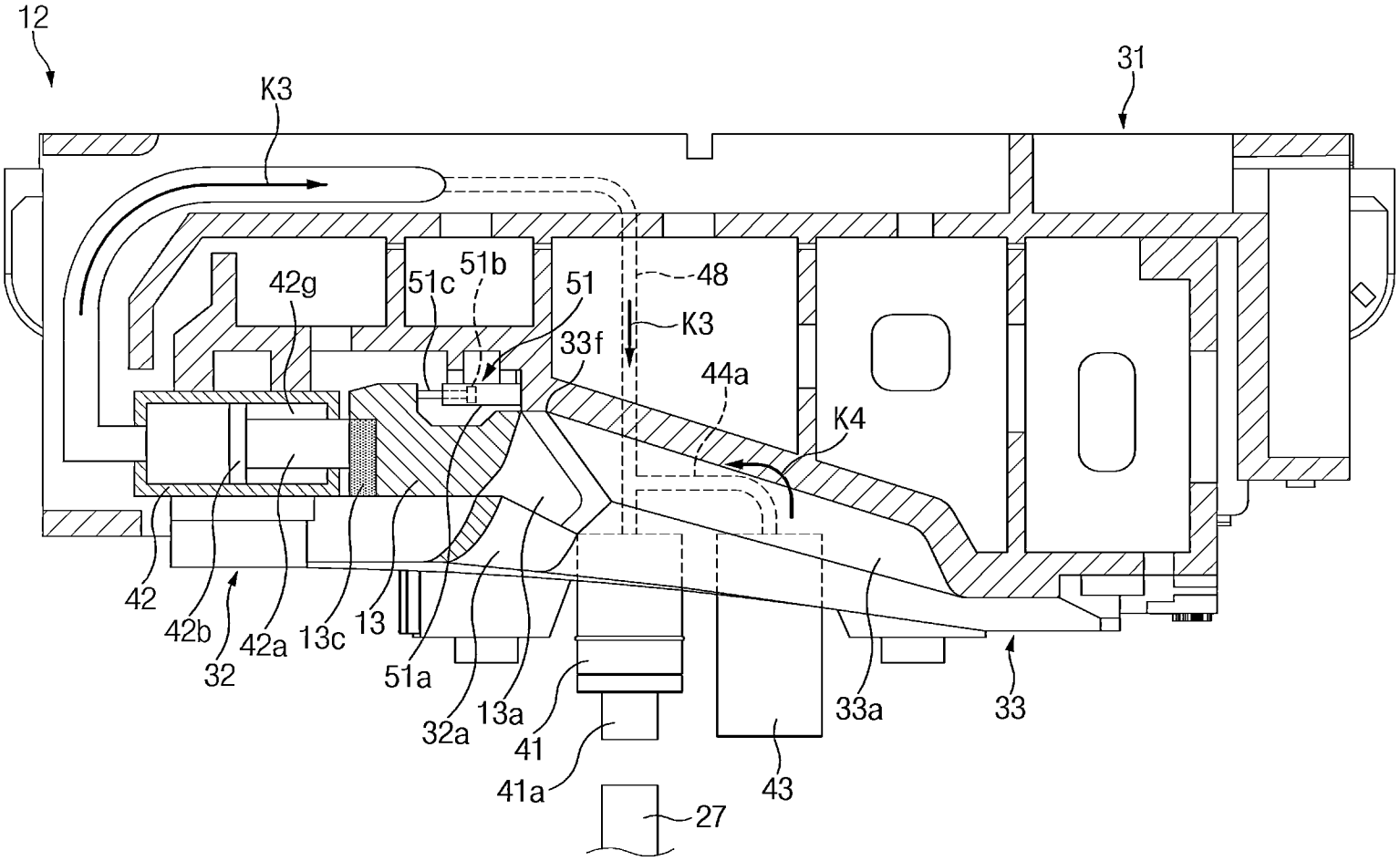
FIG. 26 is a view illustrating a state in which the power-side rod of the power cylinder is completely spaced apart from the push member when the upper die assembly is completely moved upward in the press forming apparatus according to one embodiment of the present disclosure.
Figure 27:
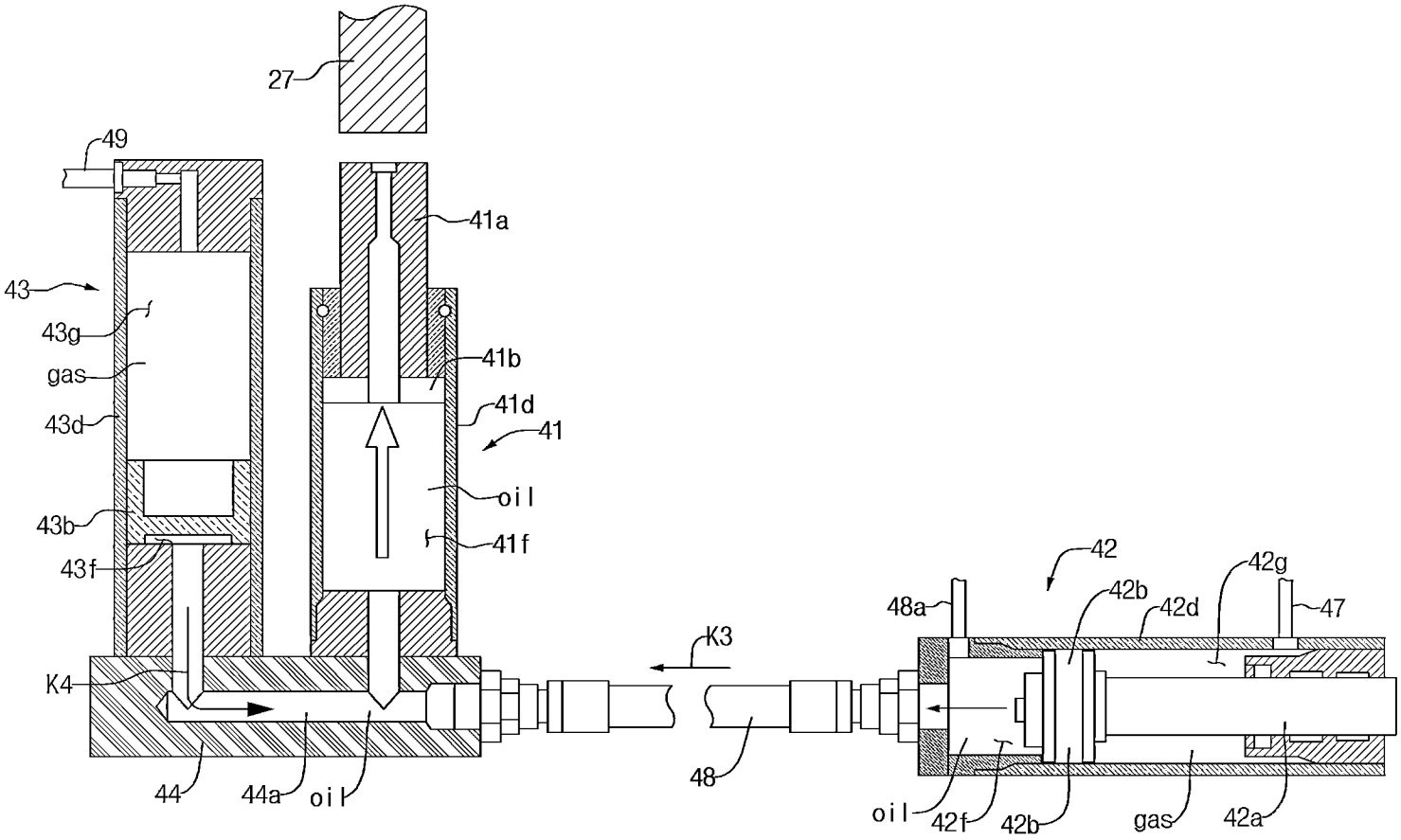
FIG. 27 is a view illustrating a process in which the hydraulic fluid contained in the force-side hydraulic chamber flows to the power-side hydraulic chamber and the hydraulic fluid contained in the tank-side hydraulic chamber flows to the power-side hydraulic chamber when the power-side rod of the power cylinder is completely spaced apart from the push member as the upper die assembly is completely moved upward in the press forming apparatus according to one embodiment of the present disclosure.

When the upper die assembly 12 is completely moved upward from the lower die assembly 11, the power-side rod 41*a* of the power cylinder 41 is completely spaced apart from the push member 27 of the lower die assembly 11, as illustrated in FIG. 26. Therefore, as illustrated in FIG. 27, the hydraulic fluid contained in the force-side hydraulic chamber 42*f* flows to the power-side hydraulic chamber 41*f* (see arrow K3), and the hydraulic fluid contained in the tank-side hydraulic chamber 43*f* flows to the power-side hydraulic chamber 41*f* (see arrow K4). Referring to FIG. 27, as the gas contained in the tank-side gas chamber 43*g* pushes the floating piston 43*b* toward the hydraulic passageway 44*a*, the hydraulic fluid contained in the tank-side hydraulic passageway 44*a* may flow to the power-side hydraulic chamber 41*f* through the hydraulic conduit 48, such that the amount of hydraulic fluid contained in the power-side hydraulic chamber 41*f* may relatively increase. Therefore, the hydraulic fluid contained in the power-side hydraulic chamber 41*f* may push the power-side piston 41*b* in a direction opposite to the hydraulic passageway 44*a*, such that the power-side rod 41*a* may be advanced from the cylinder barrel 41*d*. Further, the hydraulic fluid contained in the power-side hydraulic chamber 41*f* may push the power-side piston 41*b*, such that the power-side rod 41*a* may be returned to the advanced position. As the amount of hydraulic fluid contained in the force-side hydraulic chamber 42*f* relatively decreases, the gas contained in the force-side gas chamber 42*g* may apply the first pressure and thus push the force-side piston 42*b* toward the hydraulic conduit 48, such that the force-side rod 42*a* may be returned to the retracted position.

Figure 28:
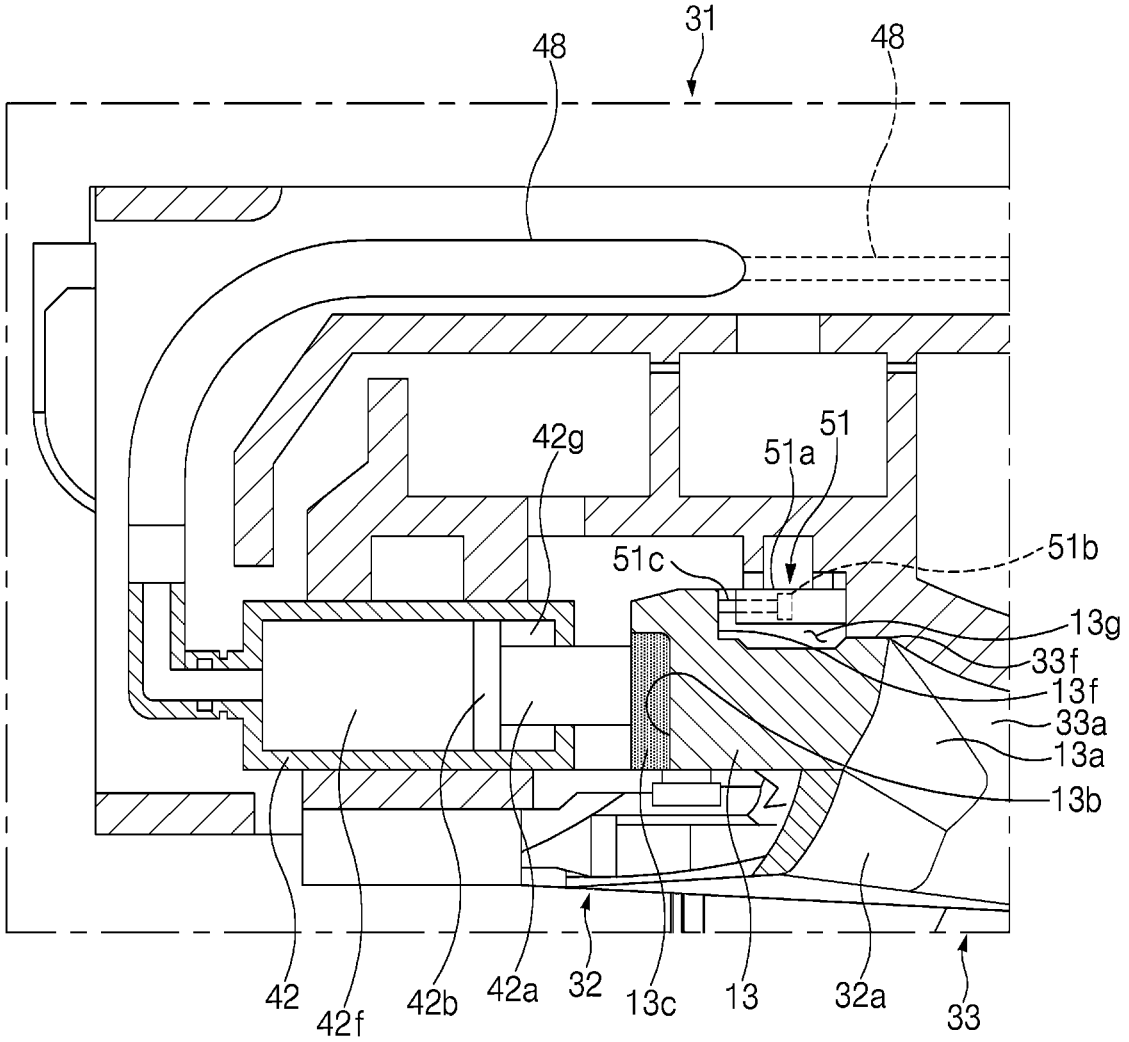
FIG. 28 is an enlarged view of portion C in FIG. 25.

Referring to FIG. 28, the press forming apparatus according to the embodiment of the present disclosure may further include a biasing member 51 that biases the cam slider 13 to the retracted position. For example, the biasing member 51 may be a gas spring including an enclosed cylinder 51*a* containing compressed gas such $N_2$, a piston 51*b* configured to slide in the enclosed cylinder 51*a*, and a rod 51*c* connected to the piston 51*b*. The enclosed cylinder 51*a* may be filled with the gas at a third pressure. The gas may apply the third pressure and push the piston 51*b* and the rod 51*c*, such that the biasing member 51 may provide a predetermined biasing force to the cam slider 13. For example, the third pressure may be 135 bar, and thus the biasing member 51 may provide a biasing force of 2.7 ton to the cam slider 13. The enclosed cylinder 51*a* of the biasing member 51 may be mounted on the upper die housing 31 of the upper die assembly 12. The cam slider 13 may have a contact surface 13*f* being in contact with a free end of the rod 51*c* of the biasing member 51. The contact surface 13*f* may be provided on an upper portion of the cam slider 13. The cam slider 13 may have an accommodation space 13*g* provided in an upper portion of the cam slider 13, and the accommodation space 13*g* may accommodate the biasing member 51, such that the cam slider 13 and the biasing member 51 may be disposed to have a compact layout. When the force-side rod 42*a* of the force cylinder 42 is returned to the retracted position by the gas contained in the force-side gas chamber 42*g*, the cam slider 13 may be returned to the retracted position by the biasing member 51. Because the third pressure in the enclosed cylinder 51*a* of the biasing member 51 is higher than the first pressure (e.g., 20 bar) in the force-side gas chamber 42*g*, the biasing member 51 may assist in returning the force-side rod 42*a* to the retracted position. As the cam slider 13 is retracted from the lower die 22 by the biasing member 51 as described above, the force-side rod 42*a* of the force cylinder 42 may be stably returned to the retracted position, and the formed workpiece W may be easily separated from the press forming apparatus.

Figure 29:
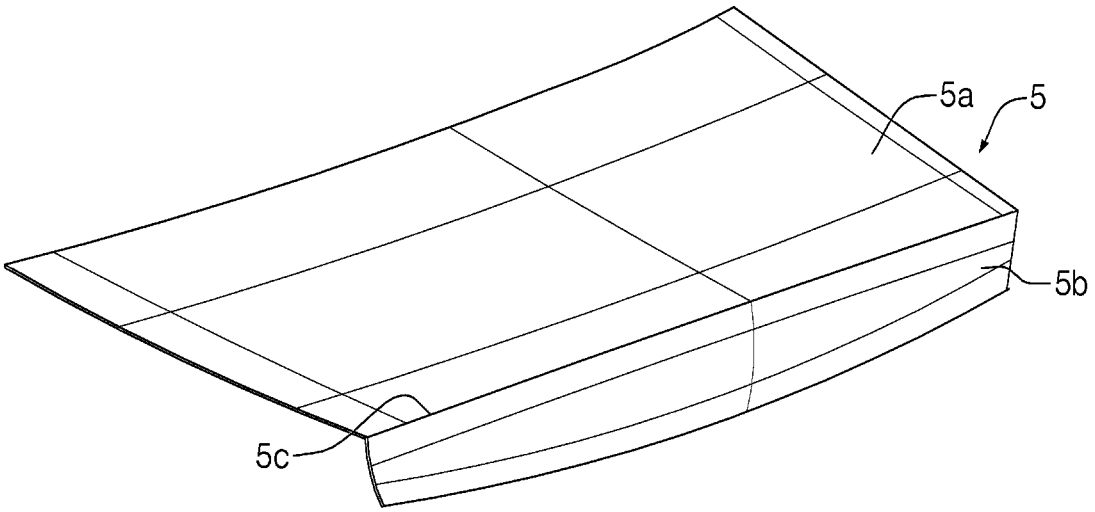
FIG. 29 is a view illustrating a trunk lid that is an example of a vehicle body component formed by the press forming apparatus according to one embodiment of the present disclosure.

FIG. 29 is a view illustrating a trunk lid 5 that is an example of a vehicle body component formed by the press forming apparatus according to the embodiment of the present disclosure. Referring to FIG. 29, the trunk lid 5 may include an upper wall 5*a*, and a rear wall 5*b* connected to the upper wall 5*a* at a predetermined angle. A rounded corner 5*c* with a relatively small radius may be formed between the upper wall 5*a* and the rear wall 5*b*. The press forming apparatus according to the embodiment of the present disclosure may precisely form the rounded corner 5*c* with the relatively small radius without causing cracks by means of the vertical movement of the upper die 33 and the horizontal movement of the cam slider 13.

The above description is simply given for illustratively describing the technical spirit of the present disclosure, and those having ordinary skill in the art to which the present disclosure pertains should appreciate that various changes and modifications are possible without departing from the essential characteristic of the present disclosure.

Therefore, the embodiments disclosed in the present disclosure are provided for illustrative purposes only but not intended to limit the technical spirit of the present disclosure. The scope of the technical spirit of the present disclosure is not limited thereby. The protective scope of the present disclosure should be construed based on the following claims, and all the technical spirit in the equivalent scope thereto should be construed as falling within the scope of the present disclosure.

DESCRIPTION OF REFERENCE NUMERALS

11: Lower die assembly
12: Upper die assembly
13: Cam slider
14: Blank holder
21: Lower die base
22: Lower die
22*a*: First forming surface
22*b*: Second forming surface
23: Gas spring
23*a*: Rod
24: Post
24*a*: Guide
26: Guide rod
27: Push member
31: Upper die housing
31*a*: Cavity
32: Cam guide
33: Upper die
33*a*: First pressing surface
40: Conversion mechanism
41: Power cylinder

41*a*: Power-side rod
42: Force cylinder
42*a*: Force-side rod
43: Tank
44: Support member
44*a*: Hydraulic passageway
45: Tank-side control block
46: Force-side control block
47: Force-side gas conduit
48: Hydraulic conduit
48*a*: Hydraulic fluid supply conduit
48*b*: Coupling block
49: Tank-side gas conduit
51: Biasing member
51*a*: Enclosed cylinder
51*b*: Piston
51*c*: Rod

What is claimed is:

1. A press forming apparatus comprising:
a lower die assembly having a lower die;
an upper die assembly having an upper die configured to be movable in a first direction relative to the lower die;
a cam slider configured to be movable in a second direction relative to the lower die; and
a conversion mechanism configured to convert a movement of the upper die assembly in the first direction into a movement of the cam slider in the second direction,
wherein the conversion mechanism is configured to provide an external force for moving the cam slider toward the lower die when the upper die assembly and the lower die assembly are closed.

2. The press forming apparatus of claim 1, further comprising:
a cam guide configured to guide the movement of the cam slider,
wherein the cam guide is disposed on at least one of the upper die assembly or the lower die assembly.

3. The press forming apparatus of claim 1, wherein the conversion mechanism is disposed on at least one of the upper die assembly or the lower die assembly.

4. The press forming apparatus of claim 1, wherein the conversion mechanism comprises:
a power cylinder including a power-side rod configured to be advanced or retracted in the first direction; and
a force-side rod hydraulically connected to the power cylinder and configured to be advanced or retracted in the second direction, and
wherein the force-side rod comprises a force cylinder directed toward the cam slider.

5. The press forming apparatus of claim 4, wherein the power-side rod is configured to be retracted when the upper die assembly comes into contact with the lower die assembly, and
wherein a hydraulic fluid flows from the power cylinder to the force cylinder as the power-side rod is retracted, such that the force-side rod is advanced.

6. The press forming apparatus of claim 4, wherein:
the power cylinder has a power-side hydraulic chamber configured to contain a hydraulic fluid,
the force cylinder has a force-side hydraulic chamber configured to contain the hydraulic fluid, and
the power-side hydraulic chamber hydraulically communicates with the force-side hydraulic chamber through a hydraulic conduit.

7. The press forming apparatus of claim 6, wherein the force cylinder comprises:
a force-side piston; and
a force-side gas chamber separated from the force-side hydraulic chamber by the force- side piston,
wherein:
the force-side rod connected to the force-side piston,
the force-side gas chamber is filled with gas at a predetermined first pressure, and
the predetermined first pressure of the gas contained in the force-side gas chamber provides a biasing force that biases the force-side rod to a retracted position.

8. The press forming apparatus of claim 7, wherein the conversion mechanism further comprises a force-side control block connected to the force-side gas chamber through a force-side gas conduit, and the force-side control block comprises a pressure gauge configured to check the predetermined first pressure.

9. The press forming apparatus of claim 6, further comprising:
a coupling block connected to the force-side hydraulic chamber through a hydraulic fluid supply conduit,
wherein the coupling block is configured to remove air from the hydraulic fluid when the force-side hydraulic chamber is filled with the hydraulic fluid through the hydraulic fluid supply conduit.

10. The press forming apparatus of claim 6, wherein the conversion mechanism further comprises a tank hydraulically connected to the power cylinder through a hydraulic passageway, and the tank comprises a tank-side hydraulic chamber configured to communicate with the power-side hydraulic chamber through the hydraulic passageway.

11. The press forming apparatus of claim 10, wherein the tank further comprises:
a floating piston configured to be movable in the tank; and
a tank-side gas chamber separated from the tank-side hydraulic chamber by the floating piston,
wherein the tank-side gas chamber is filled with gas at a predetermined second pressure, and
wherein the predetermined second pressure of the gas contained in the tank-side gas chamber provides a biasing force that biases the power-side rod to an advanced position.

12. The press forming apparatus of claim 11, wherein the conversion mechanism further comprises a tank-side control block connected to the tank-side gas chamber through a gas conduit, and the tank-side control block comprises a pressure gauge configured to check the predetermined second pressure.

13. The press forming apparatus of claim 4, further comprising:
a push member provided to face the power-side rod of the power cylinder,
wherein the push member is aligned with a longitudinal axis of the power cylinder, and
wherein the power-side rod is retracted by being pushed by the push member when the upper die assembly comes into contact with the lower die assembly.

14. The press forming apparatus of claim 1, wherein the lower die comprises:
a first forming surface directed toward the upper die;
a second forming surface directed toward the cam slider; and
a rounded corner formed between the first forming surface and the second forming surface, and
wherein the upper die comprises a first pressing surface complementary to the first forming surface, and the cam slider comprises a second pressing surface complementary to the second forming surface.

15. The press forming apparatus of claim 2, wherein the upper die assembly comprises an upper die housing on which the upper die is mounted, wherein the cam guide is mounted on the upper die housing, and wherein the movement of the cam slider is guided by the upper die and the cam guide.

16. The press forming apparatus of claim 4, wherein the cam slider comprises a pad aligned with the force-side rod of the force cylinder.

17. The press forming apparatus of claim 1, wherein the cam slider is configured to move between an advanced position to which the cam slider is advanced to press a workpiece supported on the lower die and a retracted position to which the cam slider is retracted away from the lower die, and wherein the press forming apparatus further comprises a biasing member that biases the cam slider to the retracted position.

* * * * *